US011800960B2

(12) United States Patent
Wengreen

(10) Patent No.: US 11,800,960 B2
(45) Date of Patent: Oct. 31, 2023

(54) CLEANING SYSTEMS CONFIGURED TO PICK UP PET HAIR

(71) Applicant: Everlab LLC, Sammamish, WA (US)

(72) Inventor: Eric John Wengreen, Sammamish, WA (US)

(73) Assignee: Everlab LLC, Sammamish, WA (US)

( * ) Notice: Subject to any disclaimer, the term of this patent is extended or adjusted under 35 U.S.C. 154(b) by 397 days.

(21) Appl. No.: 17/121,689

(22) Filed: Dec. 14, 2020

(65) Prior Publication Data

US 2021/0369073 A1 Dec. 2, 2021

Related U.S. Application Data

(63) Continuation-in-part of application No. 16/886,754, filed on May 28, 2020, now Pat. No. 10,874,207.

(51) Int. Cl.
*A47L 11/40* (2006.01)
*A47L 11/22* (2006.01)

(52) U.S. Cl.
CPC ..... *A47L 11/4041* (2013.01); *A47L 11/22* (2013.01); *A47L 11/4013* (2013.01)

(58) Field of Classification Search
CPC ..... A46B 13/001; A46B 9/005; A46B 13/08; A46B 15/00; A47L 25/00; A47L 11/22; A47L 11/4036
See application file for complete search history.

(56) References Cited

U.S. PATENT DOCUMENTS

| | | | |
|---|---|---|---|
| 1,236,122 | A | 8/1917 | Luella |
| 1,402,343 | A | 1/1922 | Doland |
| 1,461,814 | A | 7/1923 | Aisenstein |
| 3,651,529 | A | 3/1972 | Popeil |
| 3,747,152 | A | 7/1973 | Tsuruzawa |
| 3,842,459 | A | 10/1974 | Tsuruzawa |
| 3,885,264 | A | 5/1975 | Tsuruzawa |
| 4,007,510 | A | 2/1977 | Scoggin |
| 4,765,012 | A | 8/1988 | Ueda |
| D313,509 | S | 1/1991 | Ueda |
| D324,779 | S | 3/1992 | Ueda |
| 7,721,372 | B2 | 5/2010 | Knopow |
| 8,117,706 | B2 | 2/2012 | Sato |
| 8,984,697 | B2 | 3/2015 | Knopow |
| 10,874,207 | B1 | 12/2020 | Wengreen |
| 2008/0172809 | A1 | 7/2008 | Park |
| 2010/0325826 | A1 | 12/2010 | Knopow |

FOREIGN PATENT DOCUMENTS

| | | |
|---|---|---|
| JP | 11178766 | 7/1999 |
| JP | 2001258644 | 9/2001 |
| JP | 3557468 | 8/2004 |
| JP | 2004329618 | 11/2004 |
| JP | 2003265401 | 12/2008 |

OTHER PUBLICATIONS

US Patent 260,257; Issued Jun. 27, 1882.

*Primary Examiner* — Shay Karls

(57) ABSTRACT

Cleaning systems can remove pet hair from surfaces such as furniture and floors without requiring bulky and expensive vacuums. Hair cleaning systems can have an outer housing and a cylindrical basin that is coupled to the outer housing by a pivot. Features working in conjunction with slanted bristles enhance the efficacy of the cleaning systems.

19 Claims, 18 Drawing Sheets

CLEANING SYSTEMS CONFIGURED TO PICK UP PET HAIR

BACKGROUND

Field

Various embodiments disclosed herein relate to cleaning systems. Certain embodiments relate to cleaning systems configured to pick up pet hair.

Description of Related Art

Pets often leave unwanted hair on furniture and floors. While people love their pets, they do not want discarded pet hair covering their homes and vehicles.

Many people try to use vacuums to remove pet hair. Vacuums, however, typically struggle to pick up pet hair due to the small surface area of hair resulting in the airflow of vacuums failing to generate enough lifting force.

Thus, there is a need for systems and methods to remove hair more effectively from furniture, floors, and other surfaces in homes and vehicles.

SUMMARY

Some embodiments comprise a cleaning system configured to pick up pet hair from furniture, floors, and other surfaces. In some embodiments, a hair cleaning system comprises an outer housing and a basin pivotably coupled to the outer housing. The basin can be semi-cylindrical. The basin can be configured to hold a first hair inside the outer housing. The basin can comprise a first convex outer surface configured to at least partially protrude from a downward-facing side of the outer housing to pick up a second hair. Some embodiments comprise a first concave surface pivotably coupled to the outer housing and configured to face toward and/or contact at least a first portion of the first convex outer surface as the first convex outer surface rotates relative to the first concave surface to remove the second hair from the first convex outer surface such that the second hair enters the basin. Once the second hair is caught on the first concave surface, an additional rotation cycle of the basin can knock the second hair into an interior of the basin.

In some embodiments, a first pivot joint pivotably couples a first leftward portion of the outer housing to a second leftward portion of the basin. A second pivot joint can pivotably couple a first rightward portion of the outer housing to a second rightward portion of the basin. A basin can comprise a first axis of rotation between the first pivot joint and the second pivot joint. The basin can rotate about the first axis of rotation relative to the outer housing.

In some embodiments, a first leftward portion of the outer housing comprises a first wall that protrudes inward in a first direction that is within 20 degrees of parallel to the first axis. A second leftward portion of the basin can comprise a second wall that protrudes outward toward the first leftward portion of the outer housing in a second direction that is within 20 degrees of parallel to the first axis. The first wall can be configured to limit a maximum rotation of the basin relative to the outer housing by blocking travel of the second wall.

In some embodiments, the maximum rotation is more than 55 degrees, less than 120 degrees, and/or less than 140 degrees.

In embodiments described herein, rightward portions can have any of the rotation limiting features described in the context of leftward portions such that rightward portions can be mirror images of leftward portions. Thus, rightward portions can have any of the features configured to limit a maximum rotation of the basin relative to the outer housing.

In some embodiments, the outer housing comprises a lid and a button configured to unlatch the lid to expose an opening to an interior of the basin to enable removing hair from the interior of the basin.

In some embodiments, a first leftward portion of the outer housing comprises a third wall that protrudes inward and is coupled to the first wall such that the first wall and the third wall form a T shape and such that the third wall is configured to brace the first wall against a force of the first wall stopping a rotation of the second wall.

In some embodiments, a tray comprises the first concave surface. A third pivot joint can pivotably couple the tray to the outer housing. The first convex outer surface can comprise first bristles configured to pick up the second hair. The first concave surface can comprise second bristles configured to remove the second hair from the first convex outer surface such that the second hair enters an interior of the basin.

In some embodiments, a first side of the tray comprises second bristles and a second side of the tray located opposite to the first side of the tray comprises a first protrusion that protrudes away from the second bristles toward an interior wall of the outer housing such that the first protrusion is configured to collide with the interior wall of the outer housing to limit a rotation of the tray relative to the outer housing to limit a gap width between the tray and the basin to prevent hair from falling out of the interior of the basin through the gap width.

In some embodiments, the outer housing comprises a handle configured to enable a person to hold onto the outer housing while using the hair cleaning system. The handle can have a shape that is easy for a hand of the person to wrap around.

In some embodiments, a basin comprises an opening having a frontside and a backside. The backside can be located opposite relative to the frontside. The backside can be located closer than the frontside to the handle. The outer housing can comprise a lid configured to be movable to expose the opening to an interior of the basin to enable removing the first hair and the second hair from the interior. A pivot joint can pivotably couple the lid to the rest of the outer housing such that the lid can pivot open.

In some embodiments, a first convex outer surface of the basin comprises first bristles that are predominantly slanted toward the frontside. The basin can comprise a second convex outer surface having second bristles that are predominantly slanted toward the backside. The first concave surface can comprise third bristles that are predominantly slanted toward the lid.

In some embodiments, a hair cleaning system comprises a second concave surface having fourth bristles that are predominantly slanted toward the lid. The second concave surface can be pivotably coupled to the outer housing and configured to face toward and/or contact at least a second portion of the second convex outer surface as the second convex outer surface rotates relative to the second concave surface such that the fourth bristles are configured to remove a third hair from the second bristles of the second convex outer surface such that the third hair enters the basin.

In some embodiments, a hair cleaning system comprises a first pivot joint that pivotably couples a first leftward side of the outer housing to a second leftward side of the basin. The first pivot joint can comprise a first axis of rotation.

In some embodiments, a pivot joint comprises a shaft and a hole in which the shaft turns. The structure of the hair cleaning system can hold at least a portion of the shaft inside the hole to enable rotation between two parts of the hair cleaning system.

In some embodiments, a pivot joint comprises a shaft (or a rod) and a channel in which the shaft turns. The channel can be configured to hold a portion of the shaft (or rod) inside the channel to enable rotation between two parts of the hair cleaning system.

In some embodiments, a first leftward side of the outer housing comprises a first wall that protrudes inward in a first direction and a second wall that protrudes inward in a second direction. The first direction and the second direction can be within 10 degrees and/or within 20 degrees of parallel to the first axis of rotation.

In some embodiments, a second leftward side of the basin comprises a third wall and a fourth wall that protrude outward toward the first leftward side of the outer housing. The first wall can be configured block a first rotation of the third wall about the first axis. The second wall can be configured to block a second rotation of the fourth wall about the first axis such that the first wall and the second wall limit a maximum rotation of the basin relative to the outer housing to less than 140 degrees.

In some embodiments, the third wall protrudes outward toward the first leftward side of the outer housing in a third direction that is within 20 degrees of parallel to the first axis of rotation. The fourth wall can protrude outward toward the first leftward side of the outer housing in a fourth direction that is within 20 degrees of parallel to the first axis of rotation.

In some embodiments, a first rubber piece is located adjacent to at least one of the first wall and the third wall such that the first rubber piece is configured to provide a first cushion when the first wall blocks the first rotation of the third wall. In some embodiments, the first rubber piece is located within 1 millimeter of at least one of the first wall and the third wall.

In some embodiments, a second rubber piece is located adjacent to at least one of the second wall and the fourth wall such that the second rubber piece is configured to provide a second cushion when the second wall blocks the second rotation of the fourth wall. In some embodiments, the first rubber piece is located within 1 millimeter of at least one of the second wall and the fourth wall. The first rubber piece and the second rubber piece can be located on opposite sides of the first pivot joint.

In some embodiments, a hair cleaning system comprises a first pivot joint that pivotably couples a first leftward portion of the outer housing to a second leftward portion of the basin. The first pivot joint comprises a first axis of rotation. A first wall can be coupled to the outer housing. The first wall can be configured to limit a maximum rotation of the basin relative to the outer housing by blocking travel of a second wall of the basin.

In some embodiments, a first protrusion, a second protrusion, a third protrusion, and a fourth protrusion are spaced apart along an outer perimeter of the basin such that a cross section oriented perpendicular to the first axis comprises portions of the first protrusion, the second protrusion, the third protrusion, and the fourth protrusion. The first protrusion, the second protrusion, the third protrusion, and the fourth protrusion can protrude radially outward relative to the first axis such that the first protrusion, the second protrusion, the third protrusion, and the fourth protrusion are configured to provide traction to help rotate the basin relative to the outer housing.

In some embodiments, the outer housing comprises a first downward-facing opening and a second downward-facing opening. The first downward-facing opening and the second downward-facing opening can be located on opposite sides of the first pivot joint. The first protrusion can be configured to enter the first downward-facing opening when the basin rotates in a first direction relative to the outer housing. The fourth protrusion can be configured to enter the second downward-facing opening when the basin rotates in a second direction relative to the outer housing (such that this particular second direction is rotationally opposite relative to the first direction).

In some embodiments, a second leftward portion of the basin comprises a third wall that protrudes in a first direction and a fourth wall that protrudes in a second direction. The first direction and the second direction can be toward the first leftward portion of the outer housing and within 20 degrees of parallel to the first axis. The third wall and the fourth wall can secure a base of the first protrusion such that the base rotates with the basin.

Some embodiments comprise a hoop having the first, second, third, and fourth protrusions. In some embodiments, a hoop can comprise a cylindrical outer shape with protrusions that protrude radially outward to provide traction to help rotate the basin relative to the outer housing as a person moves the handle back and forward over a surface on which there is hair that the person wants to pick up with the hair cleaning system. In some embodiments, the hoop can be a ring shape. Embodiments use many different types of hoop shapes.

In some embodiments, a second leftward portion of the basin comprises a third wall that protrudes in a first direction and a fourth wall that protrudes in a second direction. The first direction and the second direction can be toward the first leftward portion of the outer housing and within 20 degrees of parallel to the first axis. The third wall and the fourth wall can secure the hoop such that the hoop rotates with the basin. The basin can comprise features that interlock with features of the hoop to ensure the hoop rotates with the basin while the first protrusion, the second protrusion, the third protrusion, and the fourth protrusion flex due to contact with the surface on which there is hair that the person wants to pick up.

In some embodiments, the hoop comprises rubber material and a cavity. At least a portion of the third wall can be located inside the cavity to rotationally couple the hoop to the basin. The hoop can comprise a rubber bumper configured to act as a cushion between the first wall and the second wall.

In some embodiments, the hoop comprises rubber material and a wedge shape located between the second wall and a third wall of the basin such that the wedge shape is configured to rotationally secure the hoop such that the hoop rotates with the basin while the first protrusion, the second protrusion, the third protrusion, and the fourth protrusion bend due to contact with the surface on which there is hair that the person wants to pick up.

In some embodiments, the hoop comprises a roof located on an opposite side of the first pivot joint relative to the wedge shape. The roof can comprise a first radial thickness and a second radial thickness that is at least 40 percent less than the first radial thickness such that the roof is configured to flex in an area of the second radial thickness as the hoop is pushed past the first wall during assembly of the hoop into the outer housing. The second radial thickness can be located leftward relative to the first radial thickness.

In some embodiments, at least one outward facing portion of the basin comprises bristles configured to pick up the second hair. The first axis can define a leftward direction. Leftward of the bristles, a first rubber protrusion, a second rubber protrusion, and a third rubber protrusion can be coupled to the basin, protrude radially outward relative to the first axis at least 3 millimeters, and spaced apart from each other at least 3 millimeters along a convex outer perimeter such that the first rubber protrusion, the second rubber protrusion, and the third rubber protrusion are configured to provide traction to help rotate the basin relative to the outer housing.

In some embodiments, outer facing portions of the basin comprise a central portion having bristles configured to pick up the second hair and a leftward end portion located leftward of the bristles such that the leftward end portion does not comprise bristles. The leftward end portion comprises a first rubber protrusion, a second rubber protrusion, and a third rubber protrusion that protrude radially outward relative to the first axis and that are spaced apart from each other along a convex outer perimeter of the leftward end portion such that the first rubber protrusion, the second rubber protrusion, and the third rubber protrusion are configured to provide traction to help rotate the basin relative to the outer housing.

In some embodiments, the first convex outer surface of the basin comprises first bristles configured to pick up the second hair. A basin can comprise a second convex outer surface comprising second bristles configured to pick up a third hair. The second bristles can be located closer to a handle of the outer housing than the first bristles.

In some embodiments, a hair cleaning system comprises a first protrusion that is coupled to the basin, protrudes at least 3 millimeters radially outward relative to the first axis of rotation in a first direction, and is located leftward of the first bristles. The hair cleaning system can comprise a second protrusion that is coupled to the basin, protrudes at least 3 millimeters radially outward relative to the first axis of rotation in a second direction, and is located leftward of the second bristles. An angle between the first direction and the second direction can be greater than 15 degrees and less than 80 degrees.

In some embodiments, a hair cleaning system comprises an outer housing and a basin pivotably coupled to the outer housing. The basin can be configured to hold a first hair inside the outer housing. The basin can comprise a first convex outer surface configured to pick up a second hair from a floor. A hair cleaning system can comprise a second surface pivotably coupled to the outer housing and configured to remove the second hair from the first convex outer surface such that the second hair enters the basin.

In some embodiments, a hair cleaning system comprises a first hoop coupled to the basin and having a first protrusion, a second protrusion, a third protrusion, and additional protrusions spaced apart along a first outer perimeter of the first hoop. The protrusions can be spaced equidistant apart along an entirety of an outer circumference of the first hoop and/or along a portion of the outer circumference of the first hoop. The protrusions can be cantilever beams or any other suitable shape. The first protrusion, second protrusion, third protrusion, and additional protrusions of the first hoop can be configured to contact the floor to provide traction to cause a first rotation of the basin relative to the outer housing as the outer housing is moved along the floor.

In some embodiments, the outer housing comprises a first wall and at least one of the first hoop and the basin comprises a second wall. The first wall can be configured to limit a first maximum rotation of the first hoop relative to the outer housing by blocking a first travel of the second wall such that the first hoop is configured to provide the traction to cause the first rotation as the outer housing is moved along the floor in a first forward direction but the first hoop does not cause additional rotation beyond the first rotation of the basin relative to the outer housing as the outer housing is moved further along the floor in the first forward direction. In some embodiments, the first maximum rotation is less than 140 degrees.

In some embodiments, a hair cleaning system comprises a first axis of rotation between the outer housing and the basin. The second wall can protrude leftward from a leftward side of the basin in a second direction within 20 degrees of parallel to the first axis. The first wall of the outer housing can protrude rightward from a leftward side of the outer housing in a third direction within 20 degrees of parallel to the first axis.

In some embodiments, the first hoop comprises a first cavity having a first opening oriented rightward. The basin can comprise a third wall that protrudes leftward from the leftward side of the basin in a fourth direction within 20 degrees of parallel to the first axis. The third wall can be located at least partially inside the first cavity such that the third wall rotationally locks the first hoop to the basin.

In some embodiments, the first hoop comprises a cylindrical band. The first protrusion, the second protrusion, and the third protrusion can protrude radially outward from the cylindrical band.

In some embodiments, the first hoop comprises a plurality of protrusions, the plurality of protrusions comprises the first protrusion, the second protrusion, and the third protrusion, and the plurality of protrusions protrudes radially outward from the cylindrical band and are spaced apart around at least 260 degrees of an outer circumference of the cylindrical band.

In some embodiments, the first hoop comprises a fourth protrusion that protrudes radially inward in an area adjacent to the second wall such that the fourth protrusion is configured to be a cushion between the first wall and the second wall as the first wall limits the first maximum rotation of the first hoop relative to the outer housing by blocking the first travel of the second wall. The fourth protrusion can be wedge-shaped and can be made of at least one of a rubber, a silicone, an elastomer, and a thermoplastic polyurethane.

In some embodiments, a hair cleaning system comprises a first axis of rotation between the outer housing and the basin. The basin can comprise a first cylinder that protrudes from a leftward side of the basin in a second direction that is within 20 degrees of parallel to the first axis. The basin can comprise a second cylinder that protrudes from the leftward side of the basin in a third direction that is within 20 degrees of parallel to the first axis. The first cylinder can be located at least partially inside the second cylinder. The basin can comprise a first rib and a second rib that protrude radially inward to couple the first cylinder to the second cylinder. The first hoop can be concentric with the first cylinder and the second cylinder. The hair cleaning system can comprise a pivot between the outer housing and the basin. The pivot can comprise the first cylinder. In some embodiments, the second wall is coupled to the second cylinder and protrudes radially outward from the second cylinder.

In some embodiments, the first hoop is coupled to a leftward end of the basin. The hair cleaning system further can comprise a second hoop is coupled to a rightward end of the basin, wherein the second hoop comprises cantilever beams that are at least 3 millimeters long and spaced equidistant around an entire second outer perimeter of the second hoop.

In some embodiments, a hair cleaning system comprises a first axis of rotation between the outer housing and the basin. The first hoop can comprise a cylindrical band having a first radius as measured from the first axis. The first protrusion, the second protrusion, and the third protrusion can protrude radially outward from the cylindrical band. The first convex outer surface of the basin comprises a second radius measured from the first axis. The first protrusion can comprise a maximum thickness measured along the first outer perimeter of the first hoop.

In some embodiments, the first radius plus the maximum thickness is less than the second radius such that the first protrusion is configured to bend to lay against the cylindrical band and be below a level of the first convex outer surface to prevent the first protrusion from prohibiting the first convex outer surface from contacting the floor.

In some embodiments, the outer housing comprises a third wall and the first hoop comprises a fourth wall. The third wall can be configured to limit a second maximum rotation of the first hoop relative to the outer housing by blocking a second travel of the fourth wall as the outer housing is moved along the floor in a first backward direction. The second maximum rotation can be rotationally opposite the first maximum rotation.

In some embodiments, a hair cleaning system comprises a first axis of rotation between the outer housing and the basin. The third wall of the outer housing can protrude rightward from a leftward side of the outer housing in a second direction within 20 degrees of parallel to the first axis.

In some embodiments, a hair cleaning system comprises an outer housing; a basin pivotably coupled to the outer housing, wherein the basin is configured to hold a first hair inside the outer housing, and the basin comprises a first convex outer surface configured to pick up a second hair from a floor; and a second surface pivotably coupled to the outer housing and configured to remove the second hair from the first convex outer surface such that the second hair enters the basin.

In some embodiments, a hair cleaning system comprises a first axis of rotation between the outer housing and the basin. The hair cleaning system can comprise a first hoop coupled to a leftward end of the basin and having a first protrusion, a second protrusion, and a third protrusion spaced apart along a first outer perimeter of the first hoop. The outer housing can comprise a first wall. At least one of the first hoop and the basin can comprise a second wall. The first wall can be configured to limit a first maximum rotation of the first hoop relative to the outer housing by blocking a first travel of the second wall. The first, second, and third protrusions of the first hoop can be configured to contact the floor to provide traction to cause a first rotation of the basin relative to the outer housing as the outer housing is moved along the floor until the first wall limits the first maximum rotation by blocking the first travel of the second wall. In some embodiments, the first maximum rotation is less than 140 degrees.

In some embodiments, the first hoop comprises a first cavity having a first opening oriented rightward, the basin comprises a third wall that protrudes leftward from a leftward side of the basin in a first direction within 20 degrees of parallel to the first axis, the third wall is located at least partially inside the first cavity such that the third wall rotationally locks the first hoop to the basin.

In some embodiments, a hair cleaning system comprises a pivot joint that pivotably couples the basin to the outer housing. The pivot joint can comprise a first cylinder that protrudes leftward from the basin. The basin can comprise a second cylinder that protrudes leftward from a leftward side of the basin. The basin can comprise a first rib and a second rib that couple the first cylinder to the second cylinder. The second wall can protrude radially outward from the second cylinder. The basin can comprise a fourth wall that protrudes radially outward from the second cylinder. The outer housing can comprise a fifth wall configured to limit a second maximum rotation of the first hoop relative to the outer housing by blocking a second travel of the of the fourth wall. The second maximum rotation can be rotationally opposite the first maximum rotation. A portion of the hoop can be rotationally coupled between the second wall and the fourth wall to enable the traction to cause the first rotation.

In some embodiments, a hair cleaning system comprises a pivot joint that pivotably couples the basin to the outer housing. The first hoop can comprise a roof located on an opposite side of the pivot joint relative to the first cavity. The roof can comprise a first radial thickness and a second radial thickness that is at least 40 percent less than the first radial thickness. The second radial thickness can be located leftward relative to the first radial thickness. The first radial thickness can be configured (due to its greater thickness than the second radial thickness) to resist collapse of the roof as the first hoop is pushed past the first wall during assembly of the first hoop into the outer housing. The second radial thickness can be configured to flex (while being supported from collapse by the first radial thickness) as the first hoop is pushed past the first wall during assembly of the first hoop into the outer housing to enable the first hoop to move past the first wall.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Pets often leave unwanted hair on furniture and floors. While people love their pets, they do not want discarded pet hair covering their homes and vehicles.

Many people try to use vacuums to remove pet hair. Vacuums, however, typically struggle to pick up hair due to the small surface area of hair resulting in the airflow of vacuums failing to generate enough lifting force.

Many embodiments described herein pick up hair far better than vacuums because rather than using airflow to try to pick up hair, the embodiments use bristles and as a result are amazingly effective because bristles do not require substantial surface areas like vacuums do.

Bristles can essentially act like tiny rakes; however, the hair must be removed from the rakes, which is one area in which traditional raking mechanisms fail. They may be able to grab hair, but the hair simply collects on the rakes until the hair falls off inadvertently (back onto a surface that a person wants to be free of hair) or until a person tediously removes the hair by picking at the hair by hand.

Moreover, bristles must be oriented in the correct direction to be effective. Other systems fail to orient the bristles effectively, which can cause hair to be picked up by the bristles and then inadvertently dislodge from the bristles (back onto the surface that a person wants to be free of hair). Many embodiments described herein not only remove the hair from bristles and discard the hair inside an outer housing, but also orient the bristles for maximum effectiveness.

Figure 19:
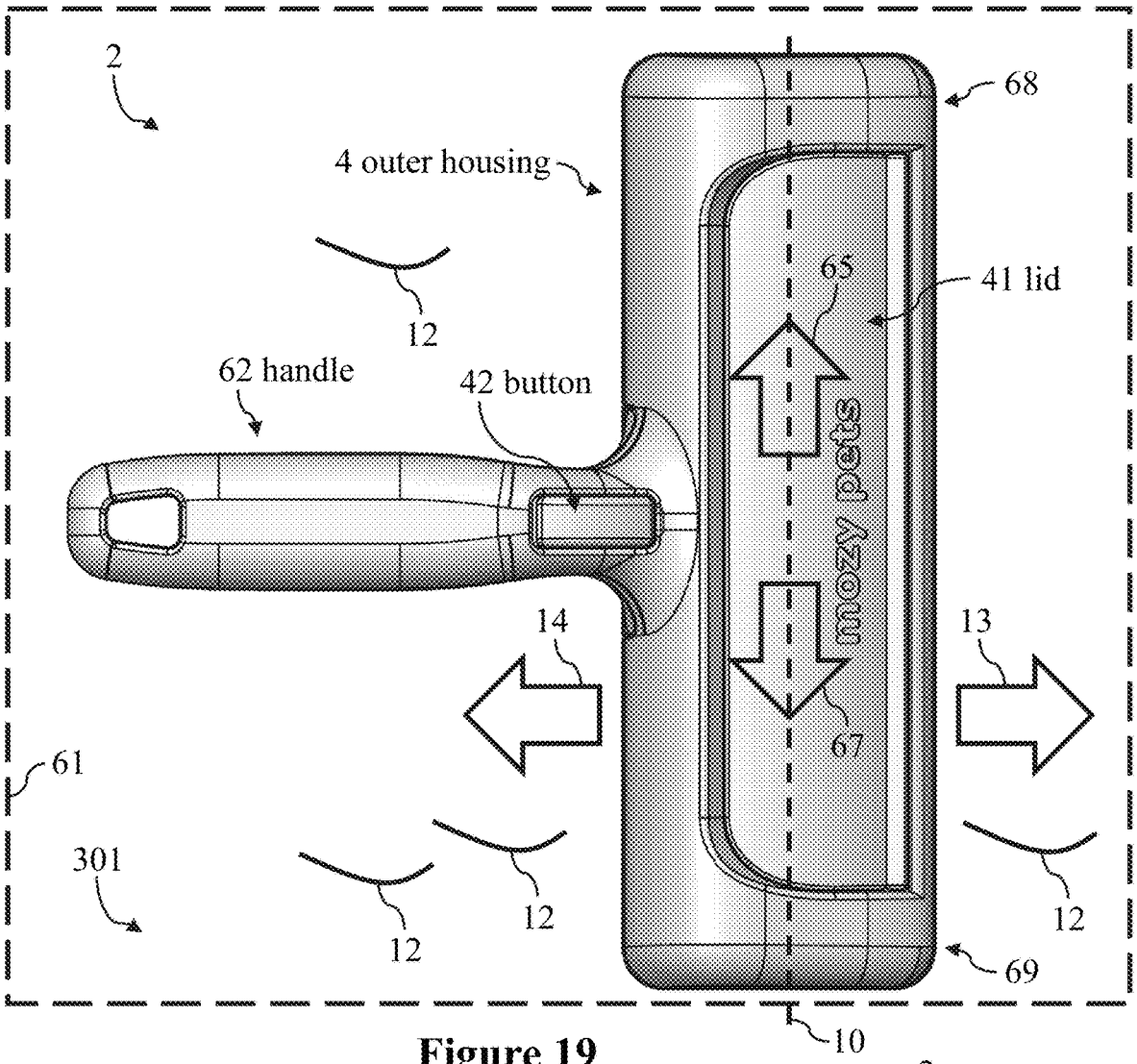
FIG. 19 illustrates a top view of the hair cleaning system, according to some embodiments.
Figure 20:
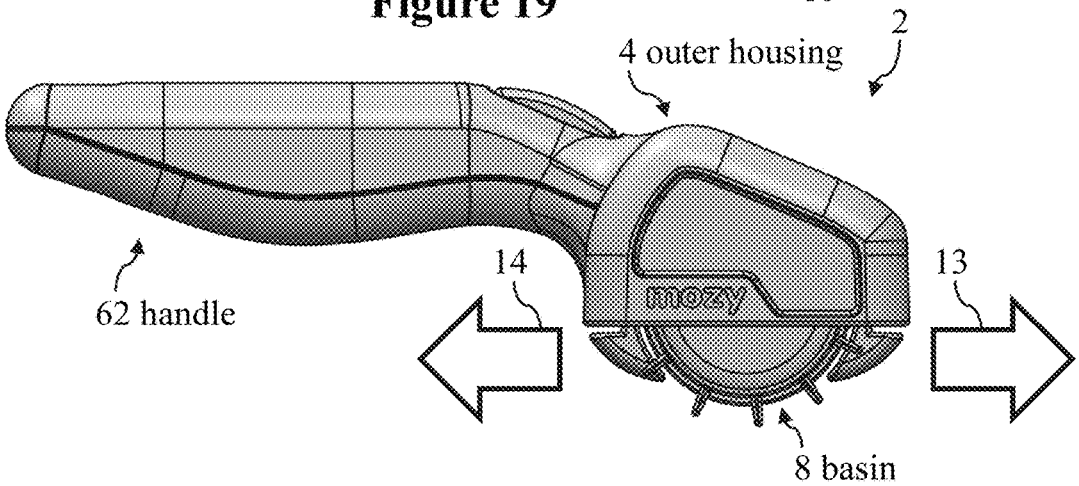
FIG. 20 illustrates a right side view of the hair cleaning system, according to some embodiments.

Referring now primarily to FIG. 19, a person can move a hair cleaning system 2 back and forth (e.g., in directions indicated by arrow 13 and arrow 14) on a surface 61 that has hair 12 that the person wants to remove. Bristles oriented radially outward relative to a central axis 10 of rotation do not pick up nearly as many hairs 12 as bristles that are predominantly slanted in a direction in which the person is move the hair cleaning system 2. For example, when a person moves the hair cleaning system 2 forward (as indicated by arrow 13 in FIG. 19), bristles should be predominantly slanted forward to greatly increase the efficacy of hair removal from the surface 61. Thus, all the bristles could be slanted forward, but a system with all bristles slanted forward would only work in the forward direction because moving backward (as indicated by arrow 14 in FIG. 19) would cause the hairs to dislodge from the bristles and return to the surface 61.

Therefore, in some embodiments, the hair cleaning system 2 needs bristles that slant forward when the person moves the hair cleaning system 2 forward (as indicated by arrow 13 in FIG. 19), but needs bristles that slant backward when the person moves the hair cleaning system 2 backward (as indicated by arrow 14 in FIG. 19). Some embodiments surprisingly achieve these remarkably contradictory requirements.

Figure 16A:
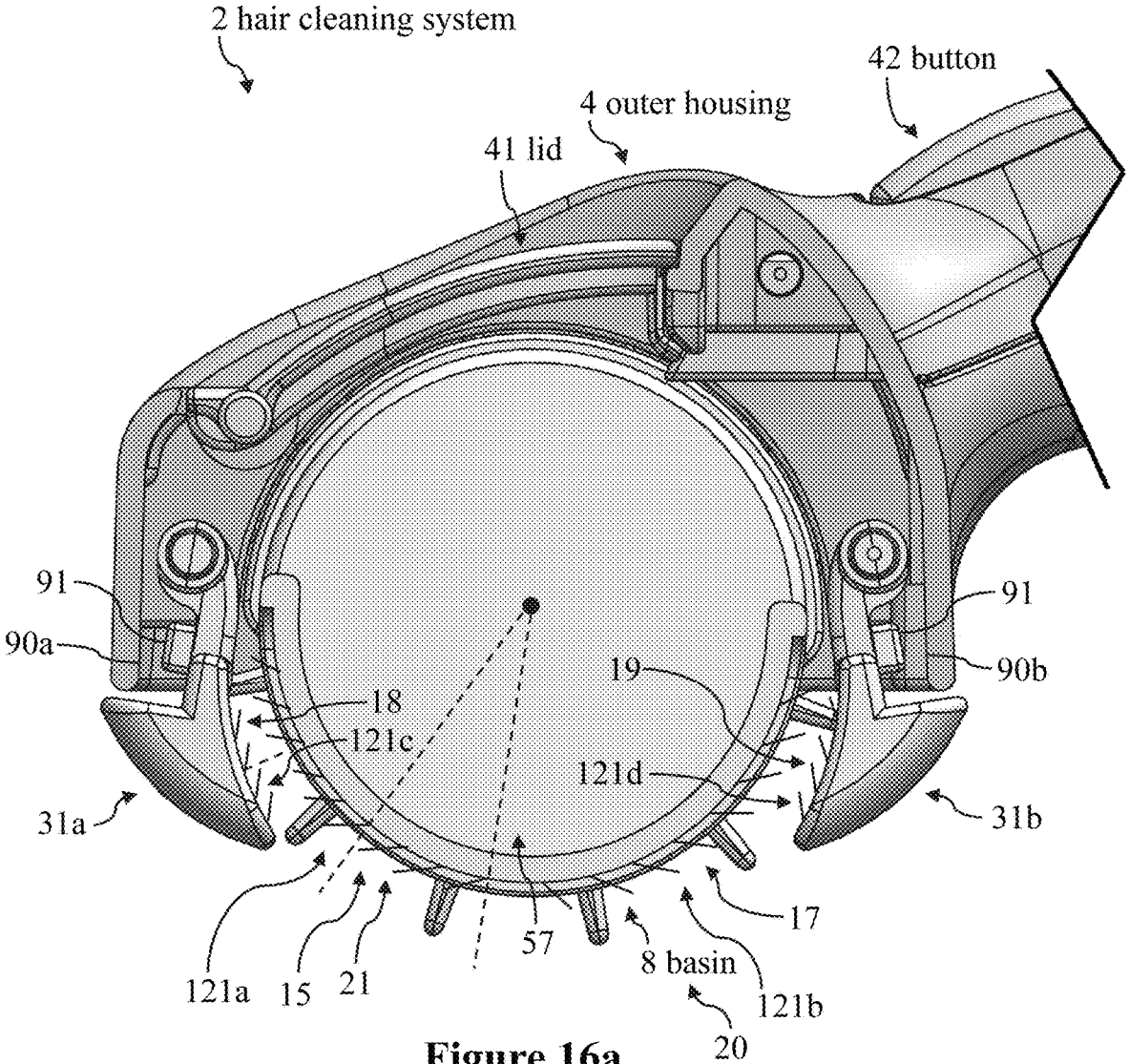
FIG. 16*a* illustrates a side view of a portion of the hair cleaning system in which a leftward portion of the hair cleaning system has been hidden, according to some embodiments.
Figure 18:
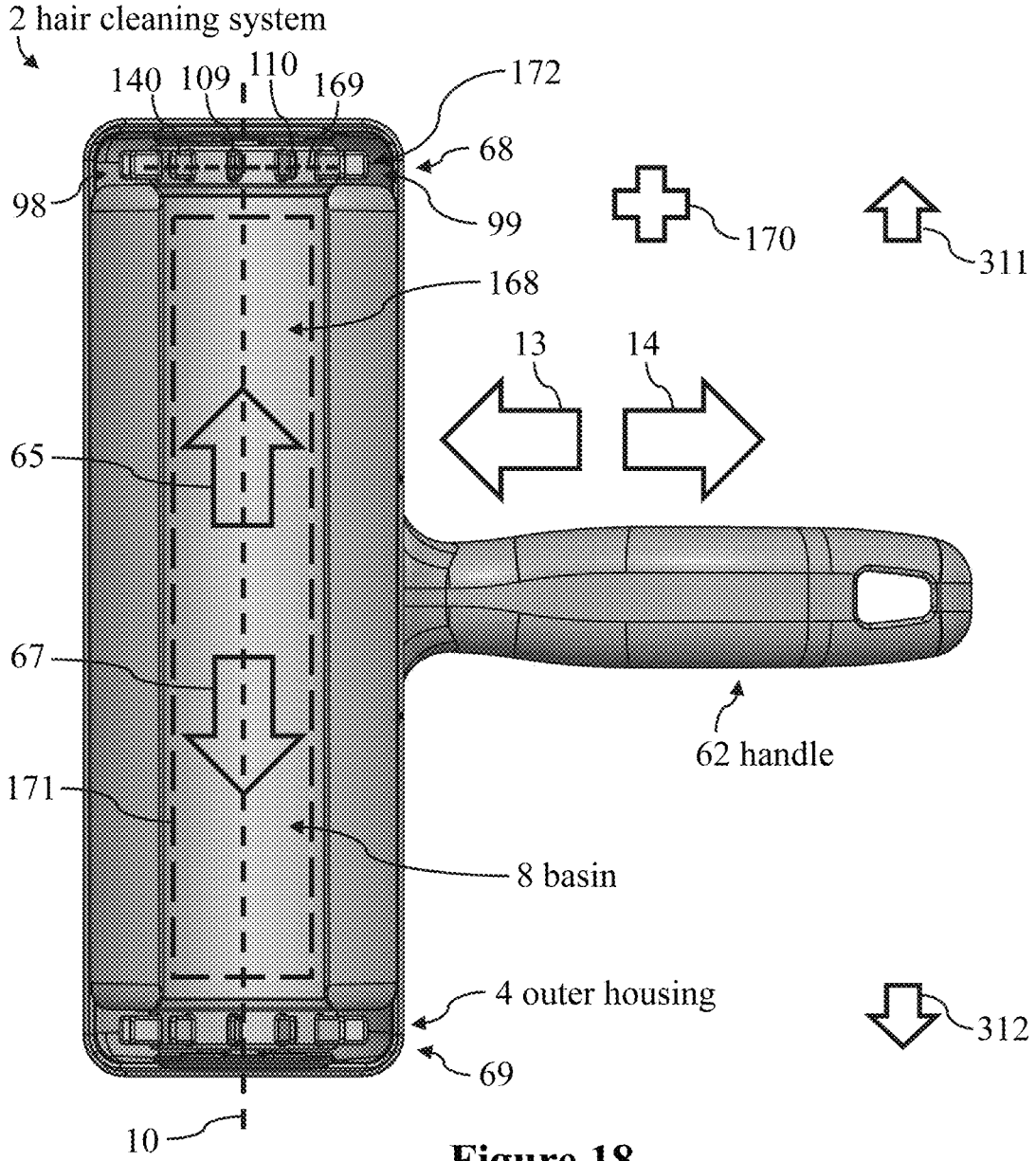
FIG. 18 illustrates a bottom view of the hair cleaning system, according to some embodiments.

As shown in FIG. 18, only a portion of a basin 8 protrudes from a downward-facing side of an outer housing 4 of the hair cleaning system 2. Bristle slant duplicity is achieved by using force from the person switching from a backward direction to a forward direction (and from a person switching from a forward direction to a backward direction) to rotate the basin 8 relative to the outer housing 4 to either expose forward facing bristles 121*a* or to expose backward facing bristles 121*b* as shown in FIG. 16*a*.

For example, when a person pushes the hair cleaning system 2 forward (as indicated by arrow 13 in FIG. 19), friction between the basin 8 and the surface 61 creates a force that rotates the basin 8 such that the forward facing bristles 121*a* are exposed from the downward-facing side of an outer housing 4. This enables the hair cleaning system 2 to pick up hairs in the forward direction.

When a person pushes the hair cleaning system 2 backward (as indicated by arrow 14 in FIG. 19), friction between the basin 8 and the surface 61 creates a force that rotates the basin 8 such that the backward facing bristles 121*b* are exposed from the downward-facing side of an outer housing 4. This enables the hair cleaning system 2 to pick up hairs in the backward direction.

Without further innovations, these forces that rotate the basin would result in a dysfunctional system that continues to rotate between forward facing bristles 121*a* and backward facing bristles 121*b* and thereby renders the system completely useless. Walls 81, 82, 83, 84 shown in FIG. 6 precisely govern the rotation of the basin 8 such that the most effective bristles are used at all times. The resulting system picks up hairs very effectively and efficiently.

Many embodiments go beyond just picking up hair by also (1) removing hair from the forward facing bristles 121*a* and backward facing bristles 121*b* and (2) discarding hair inside an outer housing 4. Spring-loaded bristle trays 31*a*, 31*b* are tuned to reliably remove hair from the forward facing bristles 121*a* and backward facing bristles 121*b* and discard the hair inside the hair cleaning system 2. Lifting mechanisms 54 ensure the spring-loaded bristle trays 31*a*, 31*b* engage and disengage at the correct times. The lifting mechanisms collide 54 with an interface 56 of the trays 31*a*, 31*b* to push the trays 31*a*, 31*b* away from the basin 8.

The spring-loaded bristle trays 31*a*, 31*b* comprise bristles 121*c*, 121*d* that are oriented such that the bristles 121*c*, 121*d* allow hair caught by basin bristles 121*a*, 121*b* to pass by the bristles 121*c*, 121*d* as a portion of the basin 8 rotates past the bristles 121*c*, 121*d*. However, the bristles 121*c*, 121*d* of the trays 31*a*, 31*b* are oriented such that hair that rotates past the bristles 121*c*, 121*d* cannot exit an interior of the hair cleaning system 2. Thus, hair is carried into the hair cleaning system 2 by basin bristles 121*a*, 121*b*, but the hair is impeded from exiting the hair cleaning system 2 by the slant of the bristles 121*c*, 121*d* of the trays 31*a*, 31*b*. The result is essentially a one-way door for hair. This one-way door also cleans the basin bristles 121*a*, 121*b* with each change of direction from forward to backward to preclude problematic hair buildup and prevent inadvertent hair dislodgement.

Without further innovations, the system would fail to work on soft surfaces and slick surfaces because soft surfaces and slick surfaces generally do not provide the forces necessary to rotate the basin 8 relative to the outer housing 4. The reliability of the system is dramatically improved by flexible protrusions 109, 110, 140, 141, 148 located on each side of the bristles. These flexible protrusions 109, 110, 140, 141, 148 do not get in the way of the basin bristles 121*a*, 121*b* (because the protrusions 109, 110, 140, 141, 148 are located leftward or rightward of the basin bristles 121*a*, 121*b*) yet gently push into the surface 61. As a result, the basin bristles 121*a*, 121*b* are highly effective at picking up hair while the protrusions 109, 110, 140, 141, 148 are highly effective at ensuring the basin 8 rotates properly.

If the protrusions 109, 110, 140, 141, 148 were located between basin bristles 121*a* and basin bristles 121*b*, the protrusions 109, 110, 140, 141, 148 could prevent at least portions of the bristles 121*a*, 121*b* from contacting the surface 61. This would cause some portions to not pick up hair, and thereby would leave paths of unpicked up hair on the surface 61.

Also, positioning protrusions 109, 110, 140, 141, 148 around a circular perimeter of the basin 8 ensures at least one (and likely more than one) protrusion contacts the surface 61 at all times during cleaning. In contrast, if the protrusions 109, 110, 140, 141, 148 were located between basin bristles 121*a* and basin bristles 121*b*, there would be times when no protrusion would contact the surface 61 (e.g., while only bristles contact the surface 61) such that the hair cleaning system would fail to generate the rotational forces necessary to rotate the basin 8 relative to the outer housing 4, and thereby would fail to move the basin 8 to expose the correct bristles, which would result in both failing to properly pick up new hairs and also in hairs that were previously picked up falling back onto the surface 61. Thus, a system in which at least one protrusion touches the surface 61 at all times is dramatically more reliable than a system in which there are times when no protrusion touches the surface.

Imagine the surface 61 is a soft couch. The protrusions 109, 110, 140, 141, 148 gently create tiny valleys in the surface 61. The interaction between the protrusions 109, 110, 140, 141, 148 and the valleys in the surface 61 create forces that cause the basin 8 to rotate relative to the outer housing 4 not primarily due to friction but instead due to interfering features. Spacing the protrusions 109, 110, 140, 141, 148 around a circular perimeter virtually guarantees that a protrusion will always be positioned such that it can contact the surface 61 (during use of the hair cleaning system 2). The result is a hair cleaning system 2 that rotates very reliably while being very gentle on surfaces being cleaned.

Embodiments can comprise bristles 121*a-g* configured to catch hair. Bristles 121*a-g* can be made from many different materials. In some embodiments, bristles 121*a-g* are fibers, hair, or filament. Bristles can be coarse or soft.

In some embodiments, bristles 121*a-g* are synthetic fibers made from polyesters, polyamides (e.g., nylon, Kevlar, Nomex, trogamide), or a conjugation of polyester, polyamide, and polypropylene.

In some embodiments, bristles 121*a-g* are microfiber bristles that are sometimes used on lint brushes. In some embodiments, bristles 121*a-g* are made with soft silicone. Bristles 121*a-g* can be large (like the bristles used on hairbrushes) or can be very small (like the bristles used on lint brushes). Bristles 121*a-g* can be part of a microfiber fabric, mat, knit, weave, etc. Bristles can be adhered to other portions of the basin 8 with adhesive.

Common manufacturing techniques enable controlling the slant of bristles. Although not all bristles of a portion of a hair cleaning system have the exact same slant angle, use of a microscope can clearly and easily reveal a predominant slant of the bristles.

As used herein, "slant" refers to an incline from a right level where the right level is placed at the base of each bristle. This definition enables analysis of bristles located on a curved surface (e.g., such as outer surfaces of the basin 8).

As used herein, a curved bristle can have a slant. As used herein, a straight bristle can have a slant. In some embodiments, bristles are oriented at many different individual angles but are predominately slanted as can be seen using a microscope if the bristles are small or by the naked eye if the bristles are large.

Figure 16B:
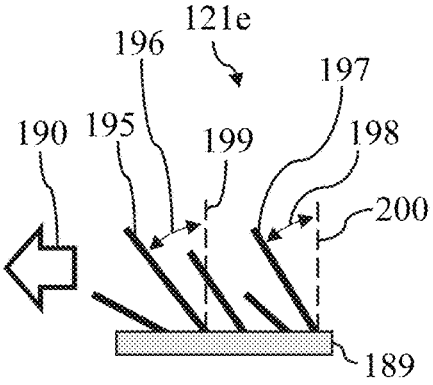
FIGS. 16*b-d* illustrate side views of surfaces with bristles, according to some embodiments.

FIG. 16*b* illustrates bristles 121*e*, which are depicted as thick black lines (e.g., 195, 197) that are coupled to a surface 189. In some embodiments, the surface 189 is part of a basin 8 (e.g., is part of a convex outer surface of a basin 8). In some embodiments, the surface 189 is part of a tray 31*a*, 31*b* (e.g., is part of a concave surface of a tray 31*a*, 31*b*).

As illustrated in FIG. 16*b*, the bristles 121*e* are predominately slanted in the direction indicated by arrow 190. An angle 196 between a bristle 195 and a right level indicator line 199 (placed perpendicular to the surface 189 at the base of the bristle 195) illustrates the precise slant of the individual bristle 195. An angle 198 between a bristle 197 and a right level indicator line 200 (placed perpendicular to the surface 189 at the base of the bristle 197) illustrates the precise slant of the individual bristle 197. The angles 196, 198 typically are not exactly the same even though the bristles 121*e* are predominately slanted in the direction indicated by arrow 190.

Figure 16C:
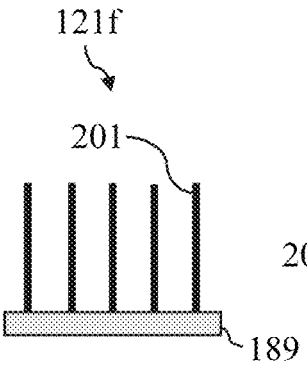

FIG. 16*c* illustrates bristles 121*f*, which are depicted as thick black lines (e.g., 201) that are coupled to a surface 189. The bristles 121*f* do not have a predominant slant because all the bristles 121*f* are oriented exactly perpendicular to the surface 189 in FIG. 16*c*.

Figure 16D:
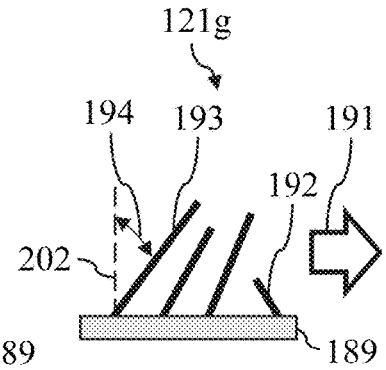
Figure 17:
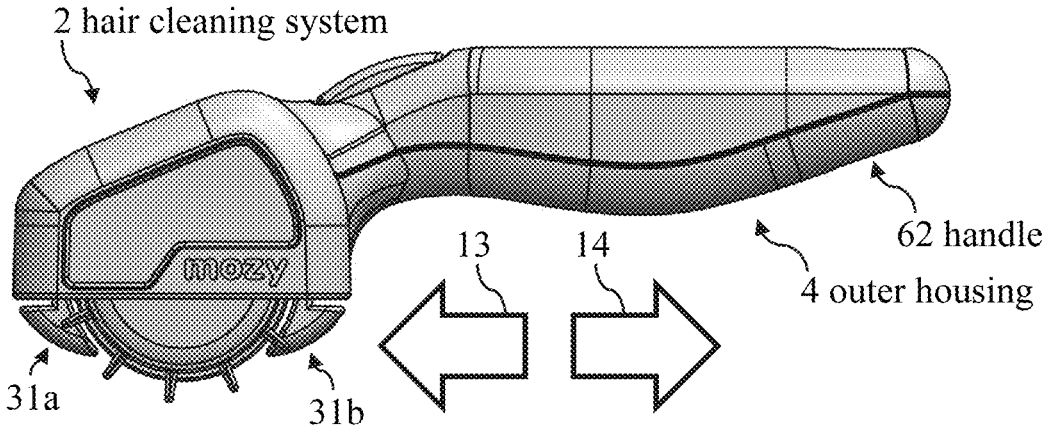
FIG. 17 illustrates a left side view of the hair cleaning system, according to some embodiments.

As illustrated in FIG. 16*d*, the bristles 121*g* are predominately slanted in the direction indicated by arrow 191. An angle 194 between a bristle 193 and a right level indicator line 202 (placed perpendicular to the surface 189 at the base of the bristle 193) illustrates the precise slant of the individual bristle 193. Note that in FIG. 16*d*, three bristles slant in one direction while a fourth bristle 192 slants in an opposite direction, however, the bristles 121*g* of FIG. 16*d* predominately slant in the direction indicated by arrow 191 because at least 75 percent of the bristles 121*g* slant in the direction indicated by arrow 191.

Figure 6:
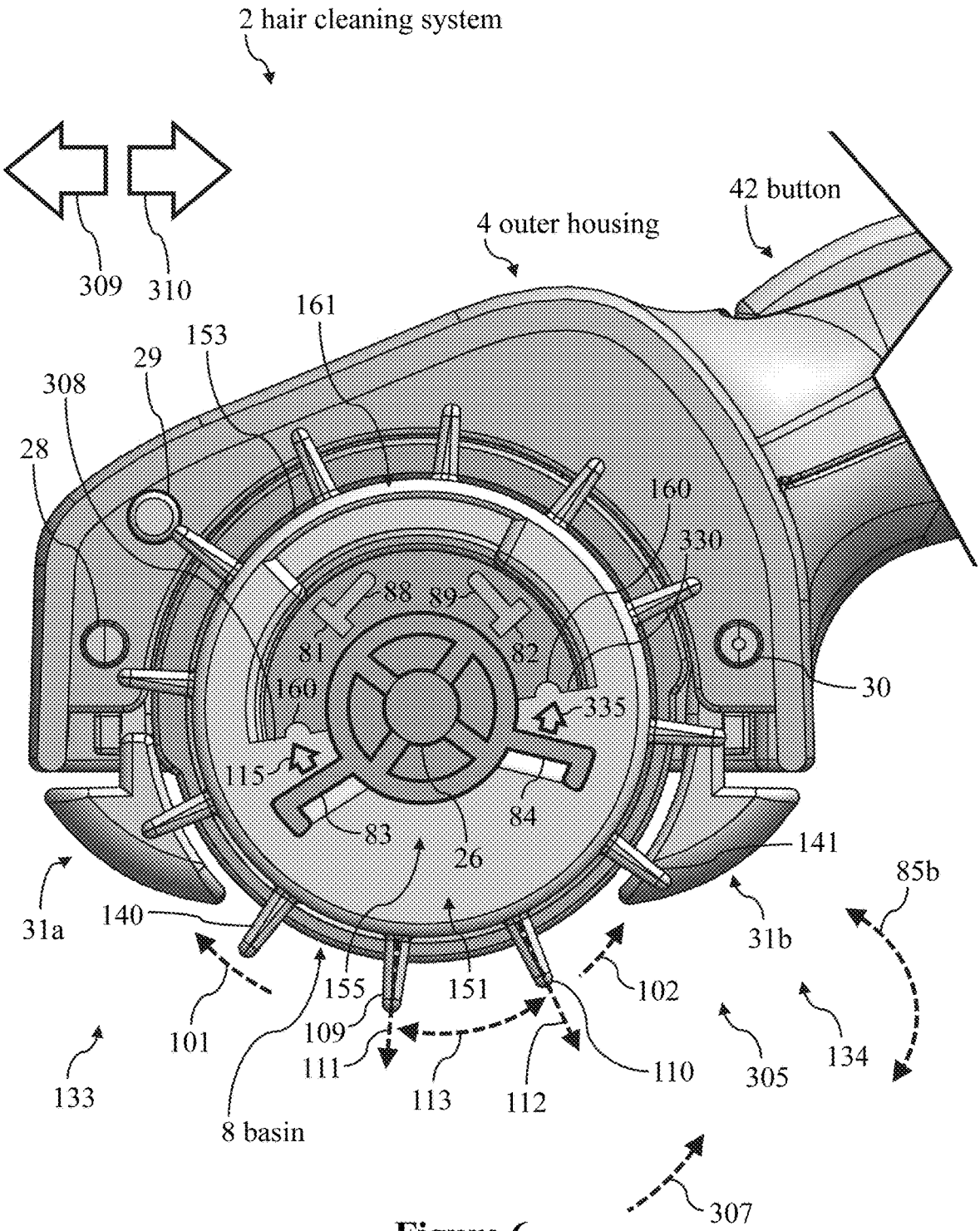
FIG. 6 illustrates a left side view of a portion of the hair cleaning system in which a leftward portion of an outer housing has been hidden, according to some embodiments.

In FIG. 6, the basin 8 can rotate relative to an outer housing 4 in a first direction 101 or in a second direction 102. The hair cleaning system 2 moves from the state illustrated in FIG. 6 to the state illustrated in FIG. 7 by the basin 8 rotating in the first direction 101 (relative to the outer housing 4). However, in the state illustrated in FIG. 7, the basin 8 cannot rotate farther in the first direction 101 because a first wall 81 of the outer housing 4 blocks movement of a second wall 83 of the basin 8. (A rubber piece of the hoop 153 is located between the walls 81, 83 to act as a cushion between the walls 81, 83.)

Figure 7:
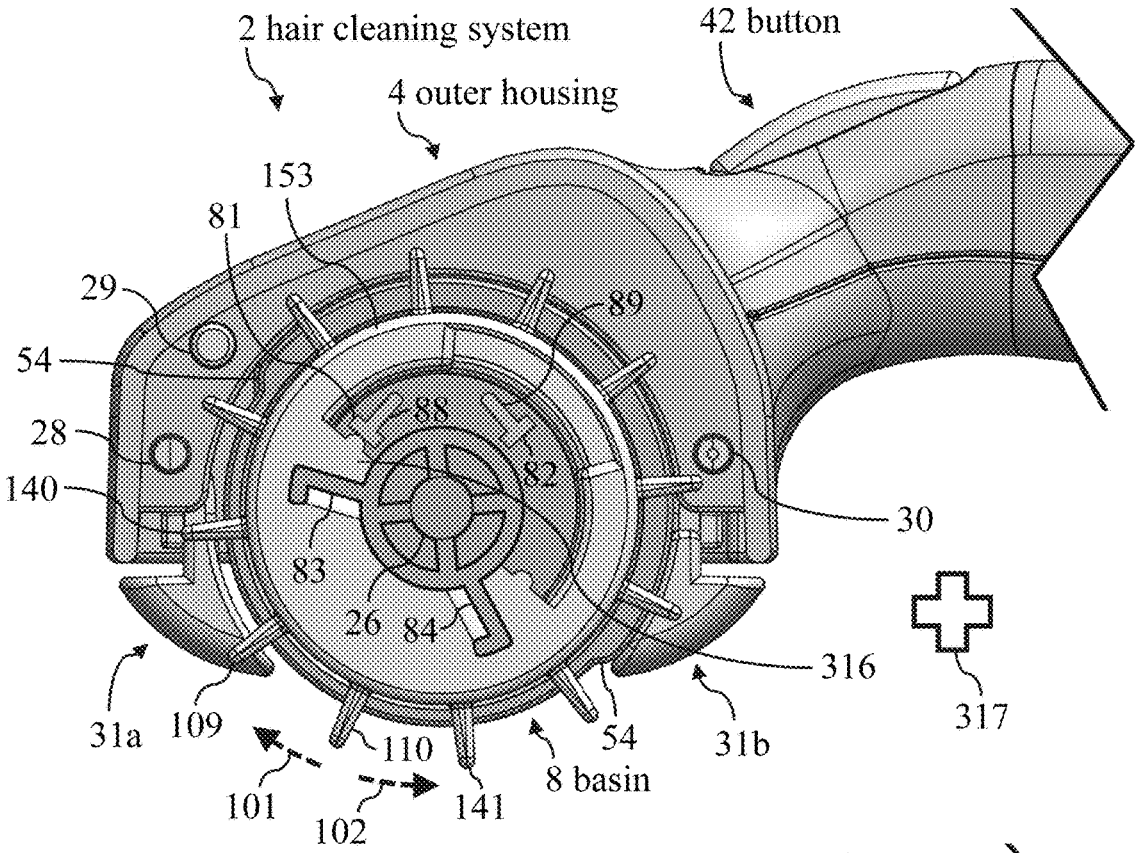
FIG. 7 illustrates a left side view of a portion of the hair cleaning system in which a leftward portion of an outer housing has been hidden, according to some embodiments.
Figure 8:
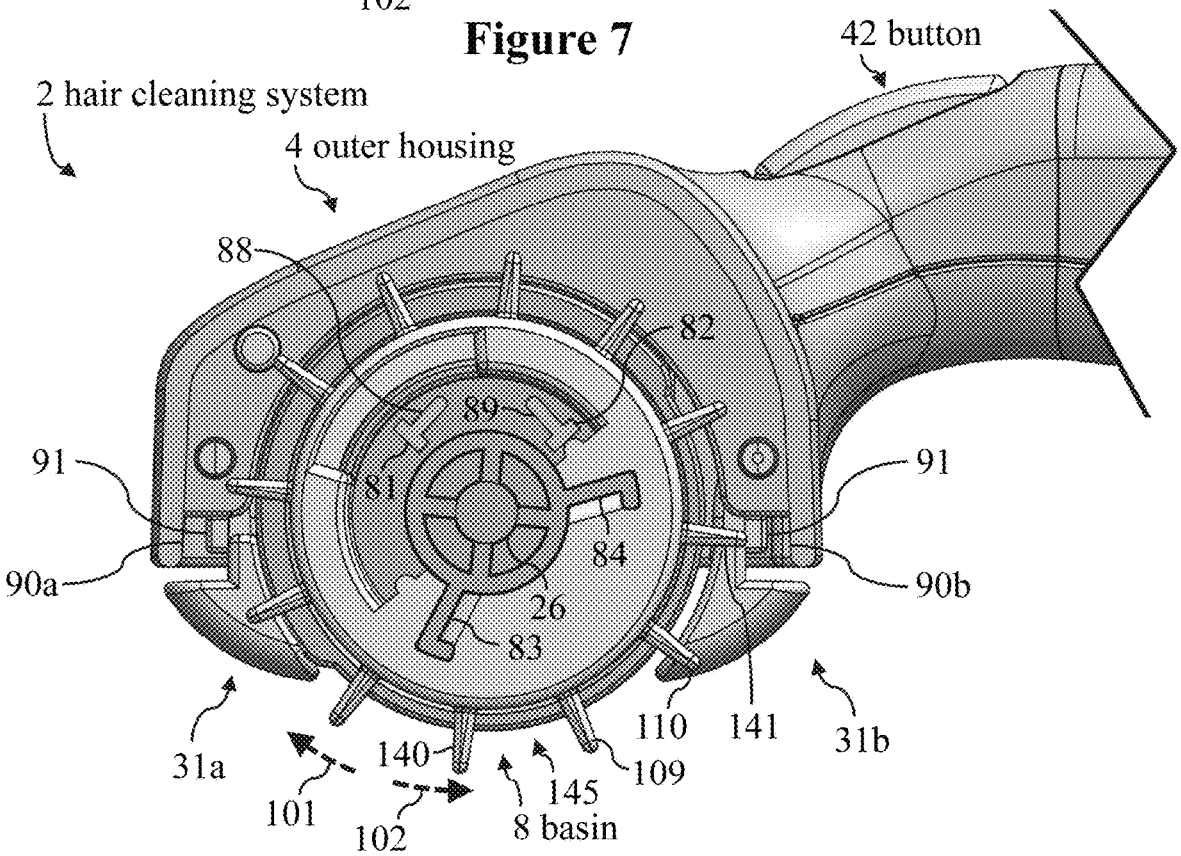
FIG. 8 illustrates a left side view of a portion of the hair cleaning system in which a leftward portion of an outer housing has been hidden, according to some embodiments.

The hair cleaning system 2 moves from the state illustrated in FIG. 7 to the state illustrated in FIG. 8 by the basin 8 rotating in the second direction 102 (relative to the outer housing 4). However, in the state illustrated in FIG. 8, the basin 8 cannot rotate farther in the second direction 102 because a third wall 82 of the outer housing 4 blocks movement of a fourth wall 84 of the basin 8. (A rubber piece of the hoop 153 is located between the walls 82, 84 to act as a cushion between the walls 82, 84.)

The hair cleaning system 2 moves from the state illustrated in FIG. 8 to the state illustrated in FIG. 7 by the basin 8 rotating in the first direction 101 (relative to the outer housing 4).

A left part of the outer housing 4 is cut away in FIGS. 5-8 but walls 81, 82, 88, 89 of the outer housing 4 are still visible because these walls 81, 82, 88, 89 are located farther rightward than the part of the outer housing 4 that was cut away.

Some embodiments comprise a hair cleaning system 2. In some embodiments, a hair cleaning system 2 comprises an outer housing 4. In several embodiments, the outer housing 4 comprises a first portion 5 and a second portion 6, although outer housing 4 embodiments have many other shapes. The outer housing 4 and other parts can be molded from acrylonitrile butadiene styrene ("ABS"). The portions 5, 6 can have mating features to hold the portions 5, 6 together. The mating features can be bonded with ABS adhesive.

In some embodiments, a hair cleaning system 2 comprises a basin 8 pivotably coupled to the outer housing 4 such that the basin 8 comprises a first axis 10 of rotation relative to the outer housing 4. Moving the hair cleaning system 2 forward (as indicated by arrow 13 in FIG. 19) and backward (as indicated by arrow 14 in FIG. 19) enables the hair cleaning system 2 to pick up hair 12. The hair 12 can be animal hair. The hair 12 can be human hair. Some embodiments are optimized to pick up dog hair. Some embodiments are optimized to pick up cat hair. Some embodiments are optimized to pick up human hair. Some embodiments pick up pet and human hair.

As used herein, a "basin" is a vessel with an open portion and at least one curving side. As used herein, a "basin" can be but is not necessarily circular. In some but not all embodiments, basins are semi-cylindrical with a hollow interior as illustrated in FIGS. 3, 4, 12, and 14.

Some embodiments are configured such that hair falls through the open portion of the basin and into an interior of the basin. In some embodiments, the basin is semi-cylindrical with a hollow middle interior portion configured to collect hair 12. In some embodiments, the basin can have an approximately semicircle cross section with a hollow interior configured to collect hair 12.

The basin 8 can be configured to hold a first hair 12*a* inside the outer housing 4. The basin 8 can comprise a first convex outer surface 15 configured to at least partially protrude from a downward-facing side 20 of the outer housing 4 to pick up a second hair 12*b*. Some embodiments comprise a first concave surface 18 pivotably coupled to the outer housing 4 and configured to contact at least a first portion 21 of the first convex outer surface 15 as the first convex outer surface 15 rotates relative to the first concave surface 18 to remove the second hair from the first convex outer surface 15 such that the second hair enters the basin 8.

In order to increase the clarity of particular items in each figure, not all items are labeled in each figure.

As used herein, when the hair cleaning system 2 is used for cleaning a surface 61, "down" refers to a direction toward the surface 61 that the hair cleaning system 2 is cleaning. Even if the hair cleaning system 2 is not currently being used to clean the surface 61, the hair cleaning system 2 still comprises a down direction based on how the hair cleaning system 2 is designed. As used herein, "up" is opposite of down.

As used herein, a side can be downward facing even if the side is not oriented perfectly parallel to the surface 61 that the hair cleaning system 2 is cleaning as long as the side is designed to generally face toward the surface 61. Thus, "downward" does not necessarily mean directly down.

As used herein, an opening can be downward facing even if the opening is not oriented perfectly parallel to the surface 61 that the hair cleaning system 2 is cleaning as long as the opening is designed to generally face toward the surface 61.

Similarly, "upward" need not be a direction perfectly perpendicular to the surface 61 because upward includes many directions away from the surface 61.

As used herein, the hair cleaning system 2 comprises a front direction (as indicated by arrow 13 in FIGS. 17-20) and a back direction (as indicated by arrow 14 in FIGS. 17-20). As used herein, back is a direction opposite of front. As used herein, a first item can be frontward of a second item even if a direction from the second item to the first item is not parallel to the surface 61 as long as the direction moves toward the front (even if the direction is at an angle rather than being directly to the front).

In some embodiments, a basin 8 comprises an opening 55 having a frontside 63 and a backside 64. The backside 64 can be located opposite relative to the frontside 63. The backside 64 can be located closer than the frontside 63 to the handle 62. The basin 8 is configured to rotate so a location of the frontside 63 and a location of the backside 64 will change depending on the rotational position of the basin 8, however, the frontside 63 and the backside 64 are easily identifiable based on a rotational position of the basin 8 in which the frontside 63 and the backside 64 are an equal distance from the surface 61.

Figure 22:
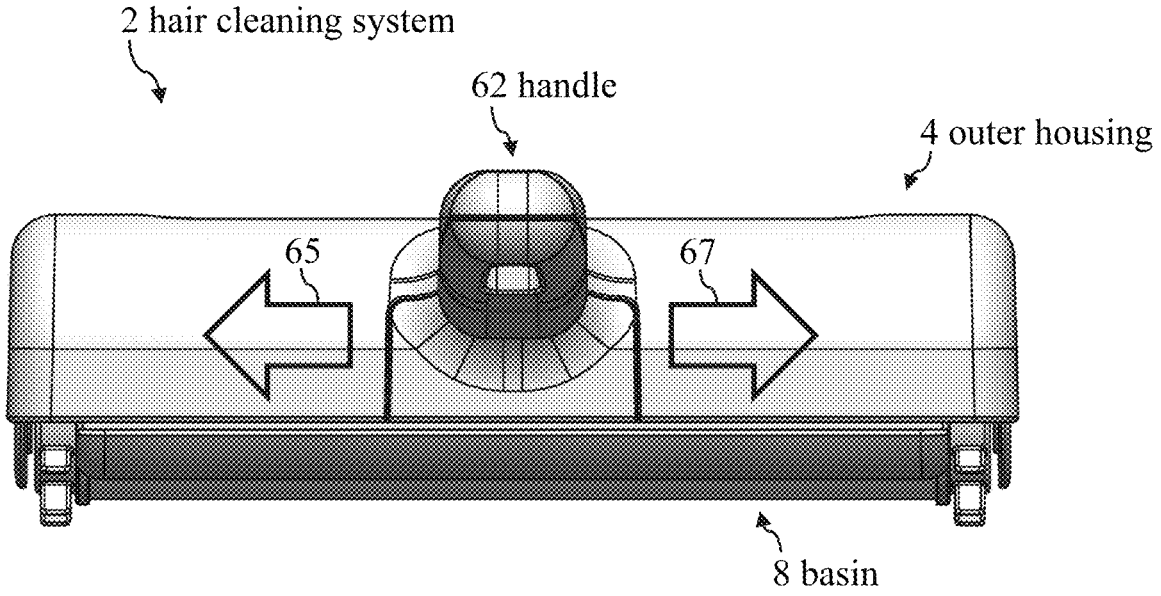
FIG. 22 illustrates a back view of the hair cleaning system, according to some embodiments.
Figure 23:
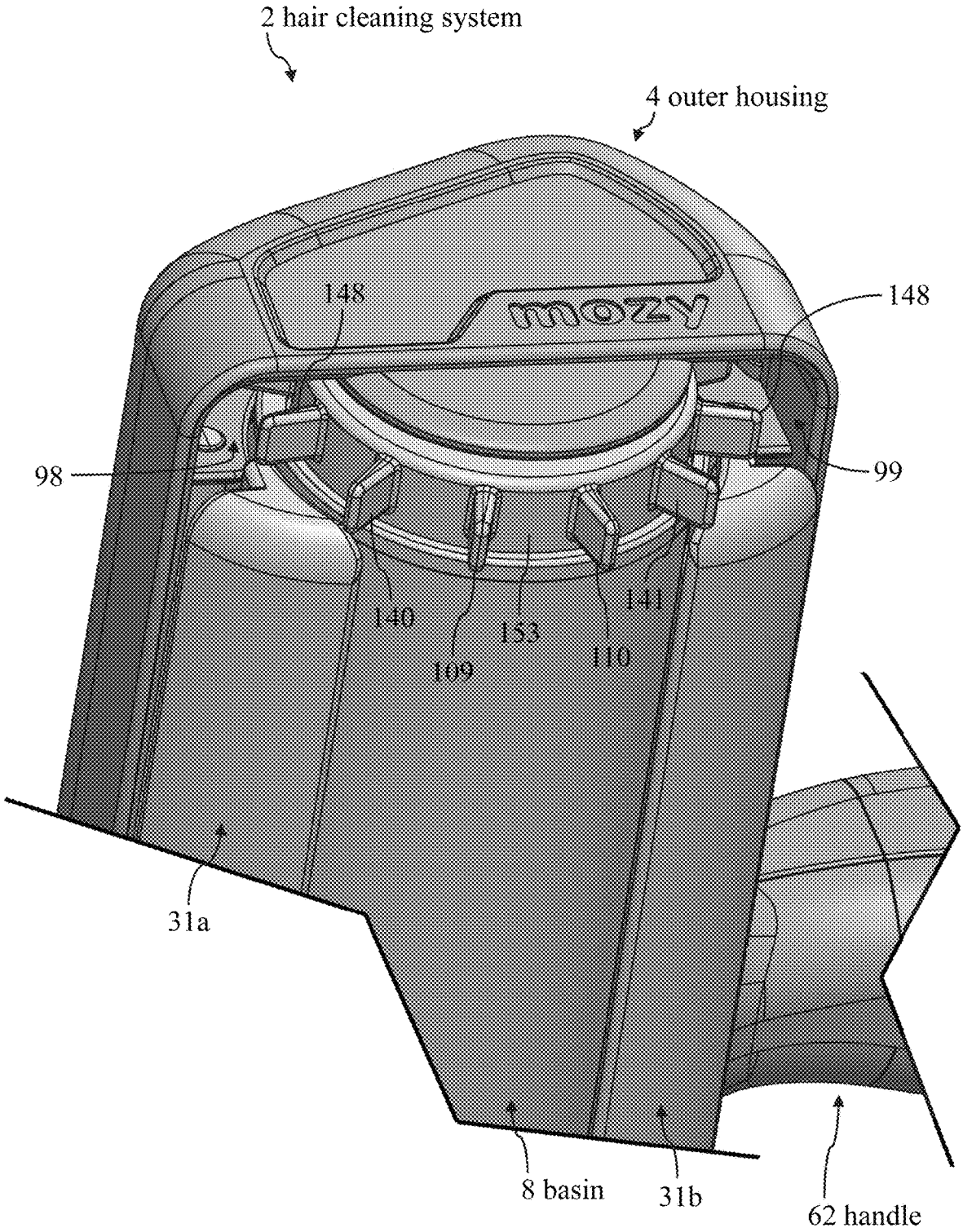
FIG. 23 illustrates a perspective view of portions of the hair cleaning system, according to some embodiments.

The basin 8 can rotate about a first axis 10 of rotation relative to the outer housing 4. A left direction 65 and a right direction 67 are based on this axis 10 of rotation between the basin 8 and the outer housing 4. As used herein, the left direction 65 and the right direction 67 are based on the perspective shown in FIG. 22, which shows looking directly at the backside of the hair cleaning system 2. As used herein, "leftward" is a direction that is at least generally to the left and does not necessarily mean directly left. As used herein, "rightward" is a direction that is at least generally to the right and does not necessarily mean directly right.

In some embodiments, a first pivot joint 24 pivotably couples a first leftward portion 68 of the outer housing 4 to a second leftward portion 70 of the basin 8. A second pivot joint 24*a* can pivotably couple a first rightward portion 69 of the outer housing 4 to a second rightward portion 71 of the basin 8. A basin 8 can comprise a first axis 10 of rotation between the first pivot joint 24 and the second pivot joint 24*a*. The basin 8 can rotate about the first axis 10 of rotation relative to the outer housing 4.

The second pivot joint 24*a* can be a mirror image of the first pivot joint 24. The second pivot joint 24*a* can have any of the features of the first pivot joint.

In some embodiments, a first leftward portion 68 of the outer housing 4 comprises a first wall 81 that protrudes inward in a first direction 87 that is within 20 degrees of parallel to the first axis 10. A second leftward portion 70 of the basin 8 can comprise a second wall 83 that protrudes outward toward the first leftward portion 68 of the outer housing 4 in a second direction 92 that is within 20 degrees of parallel to the first axis 10. The first wall 81 can be configured to limit a maximum rotation 85 of the basin 8 relative to the outer housing 4 by blocking travel 115 of the second wall 83.

In some embodiments, the maximum rotation is more than 55 degrees, less than 120 degrees, and/or less than 140 degrees. Limiting the maximum rotation 85 prevents hair 12 from falling out of an interior of the base 8.

In embodiments described herein, rightward portions can have any of the rotation limiting features described in the context of leftward portions such that rightward portions can be mirror images of leftward portions. Thus, rightward portions can have any of the features configured to limit a maximum rotation 85 of the basin 8 relative to the outer housing 4.

Figure 1:
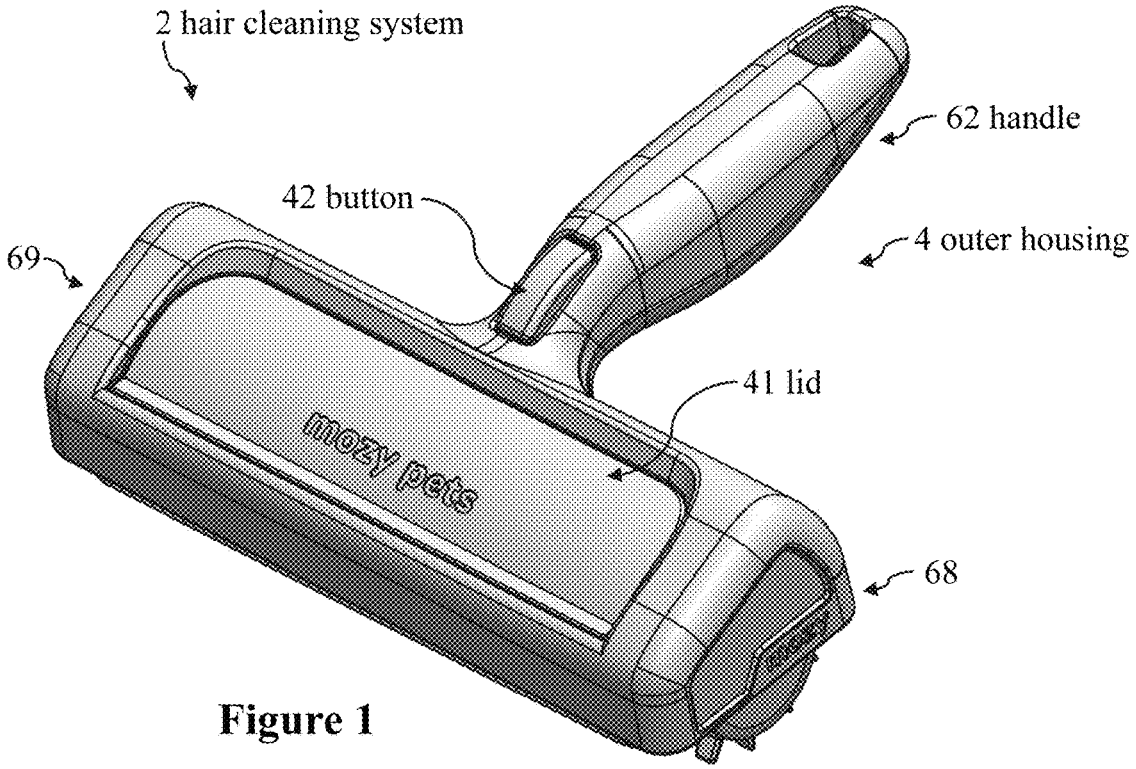
FIGS. 1 and 2 illustrate perspective views of a hair cleaning system, according to some embodiments.
Figure 2:
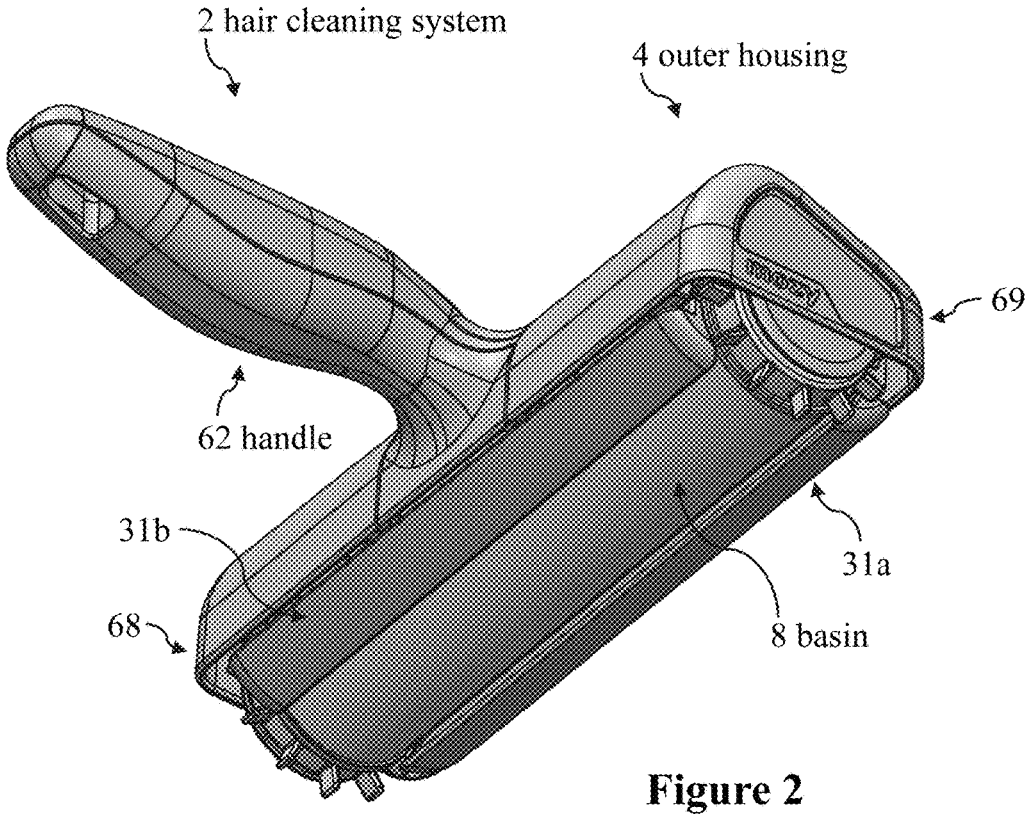
Figure 3:
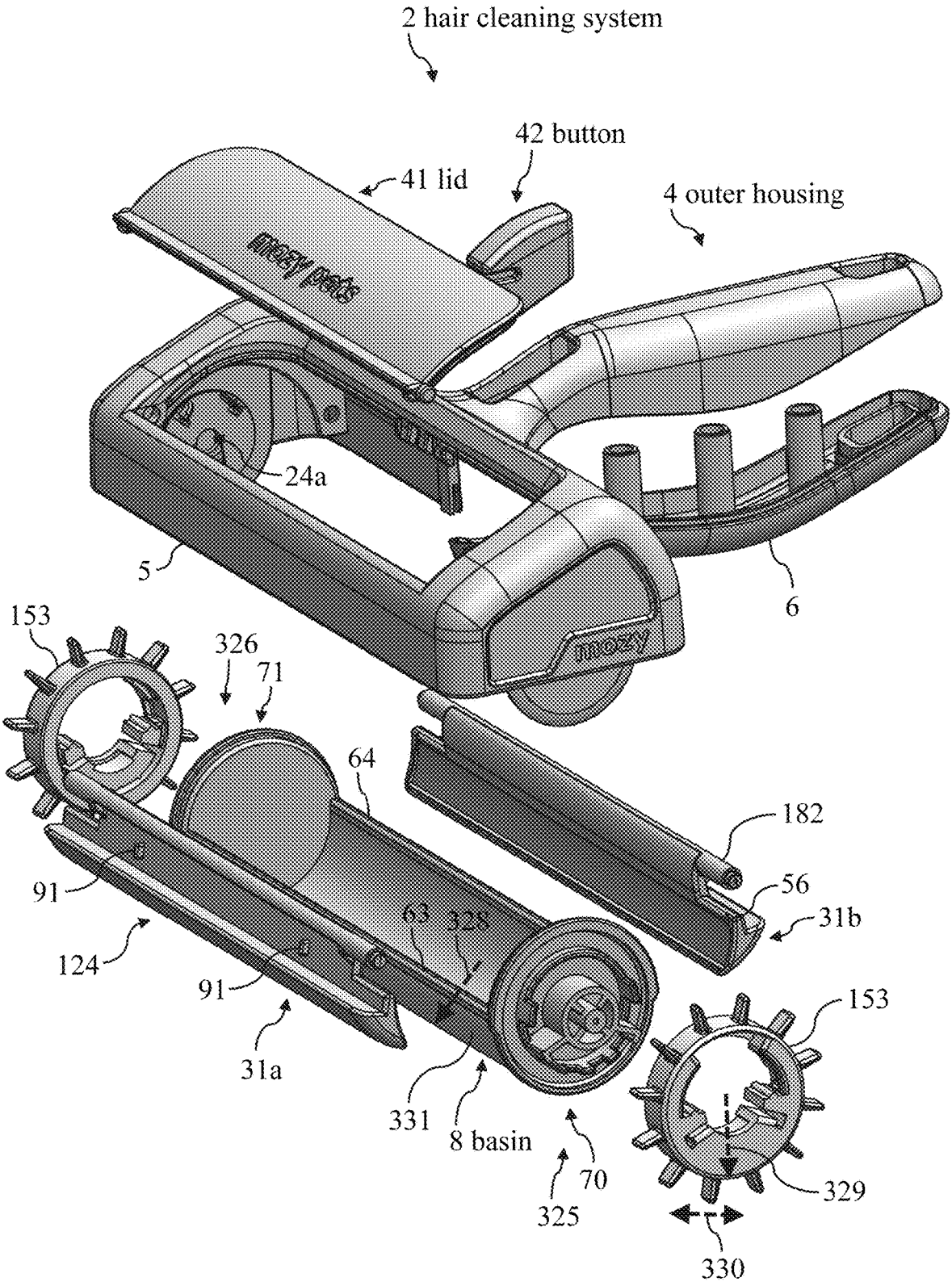
FIGS. 3 and 4 illustrate perspective, exploded views of the hair cleaning system, according to some embodiments.
Figure 4:
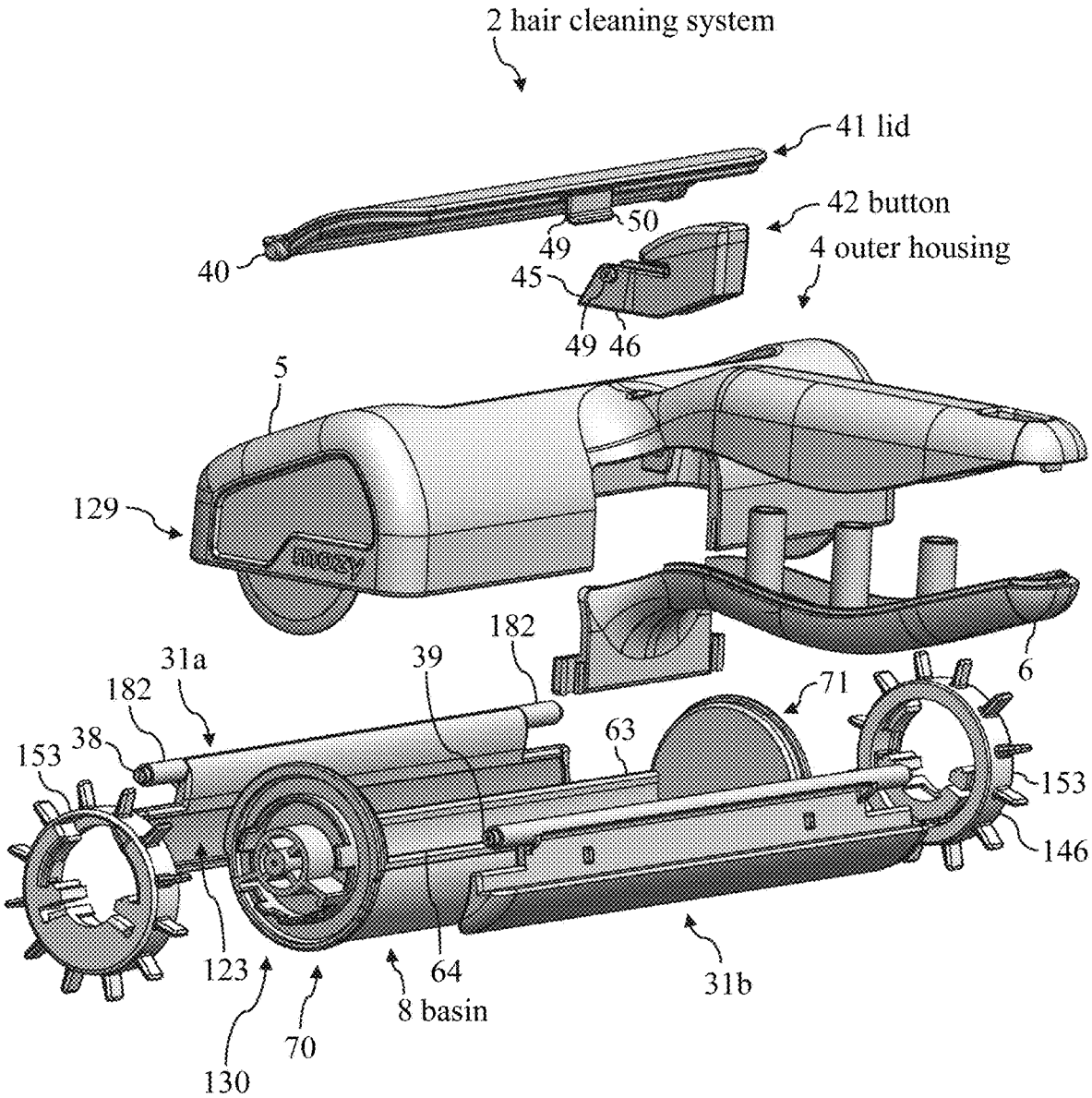
Figure 5:
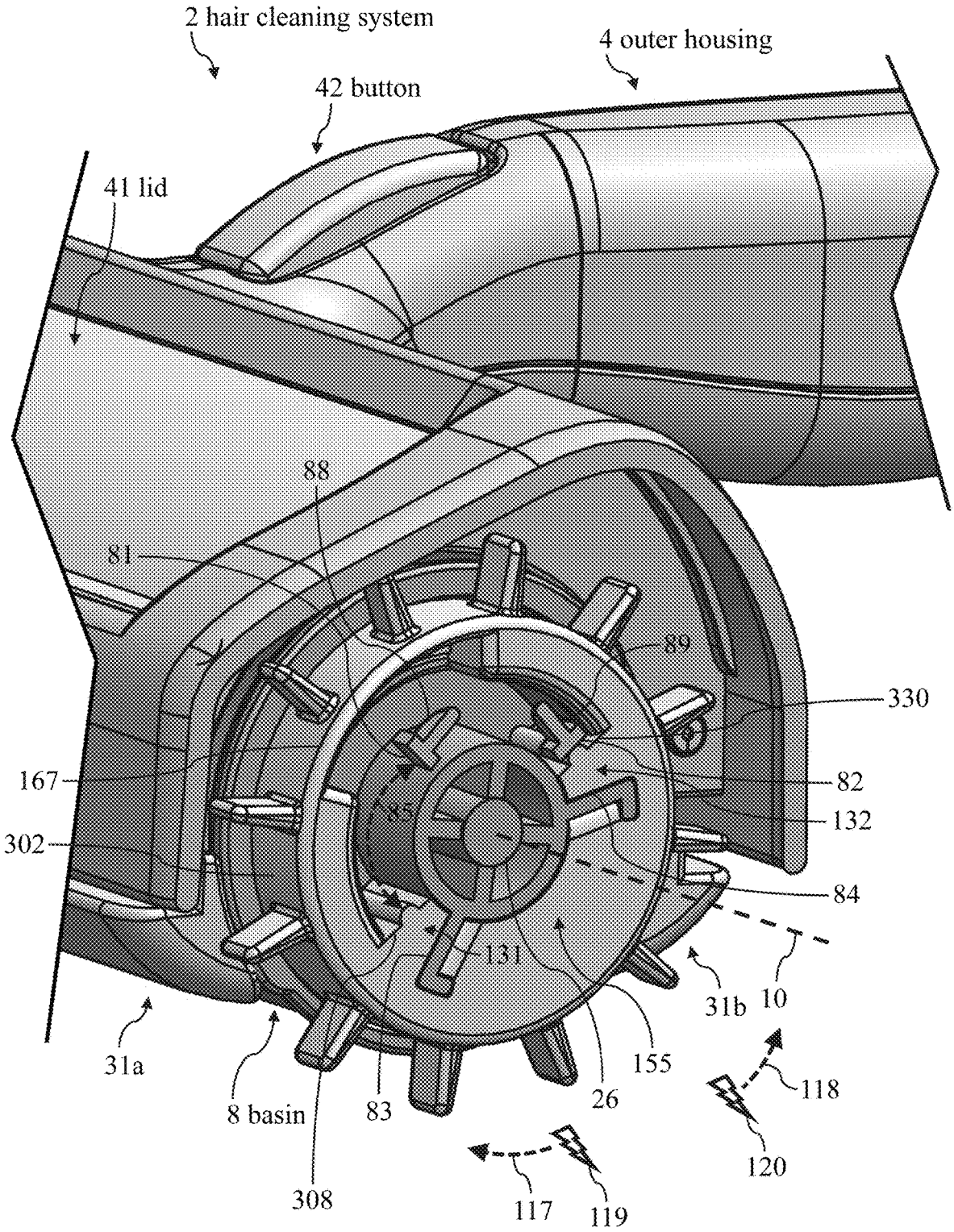
FIG. 5 illustrates a perspective view of a portion of the hair cleaning system in which a leftward portion of an outer housing has been hidden, according to some embodiments.
Figure 12:
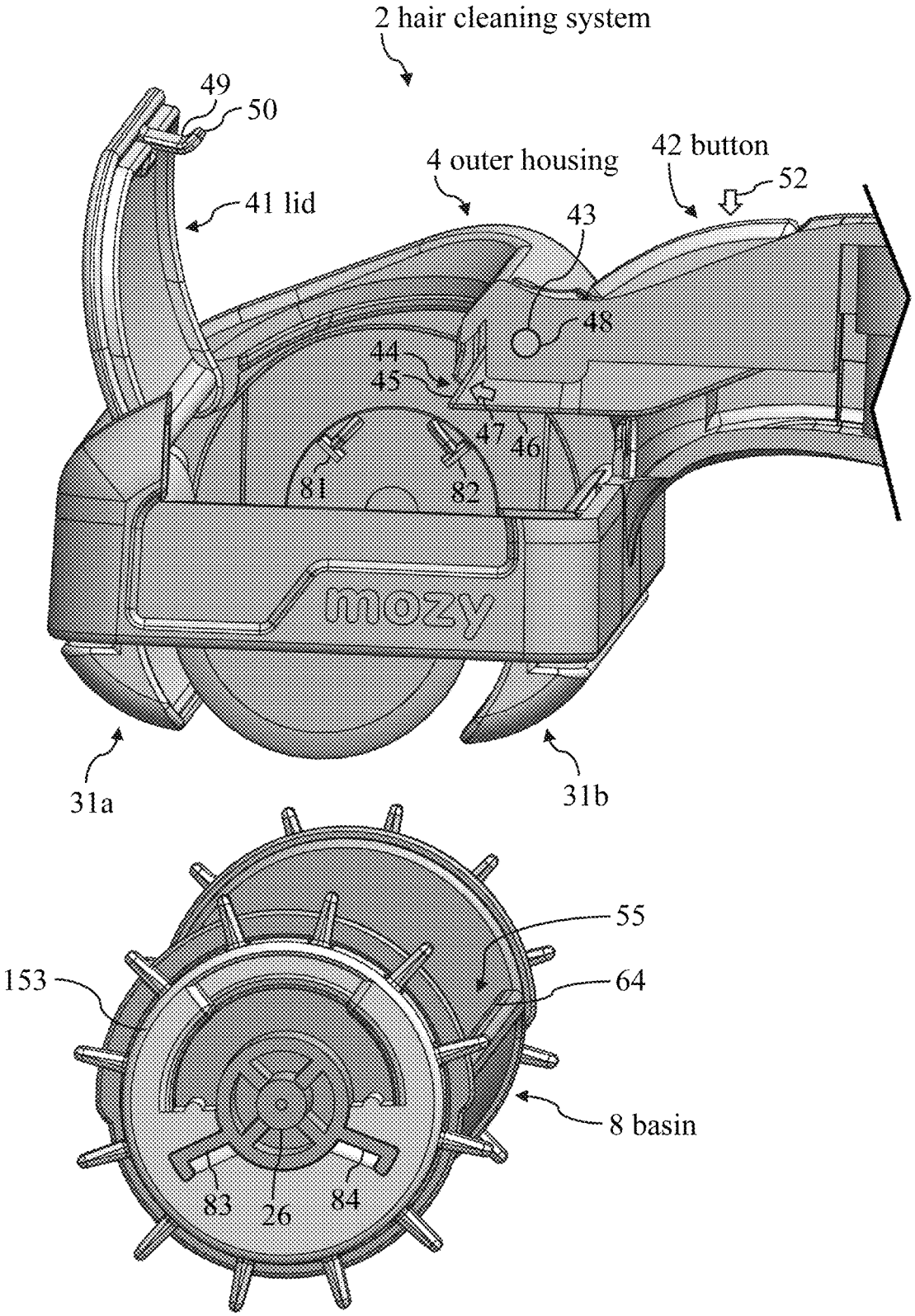
FIG. 12 illustrates a perspective view of a portion of the hair cleaning system in which the lid is open, a portion of an outer housing has been hidden, and a basin assembly has not yet been pushed upward into the outer housing, according to some embodiments.

Referring now primarily to FIGS. 4 and 12, the outer housing 4 can comprise a lid 41 and a button 42 configured to unlatch the lid 41 to expose an opening 55 to an interior 57 of the basin 8 to enable removing the first hair and the second hair from the interior 57.

Figure 11:
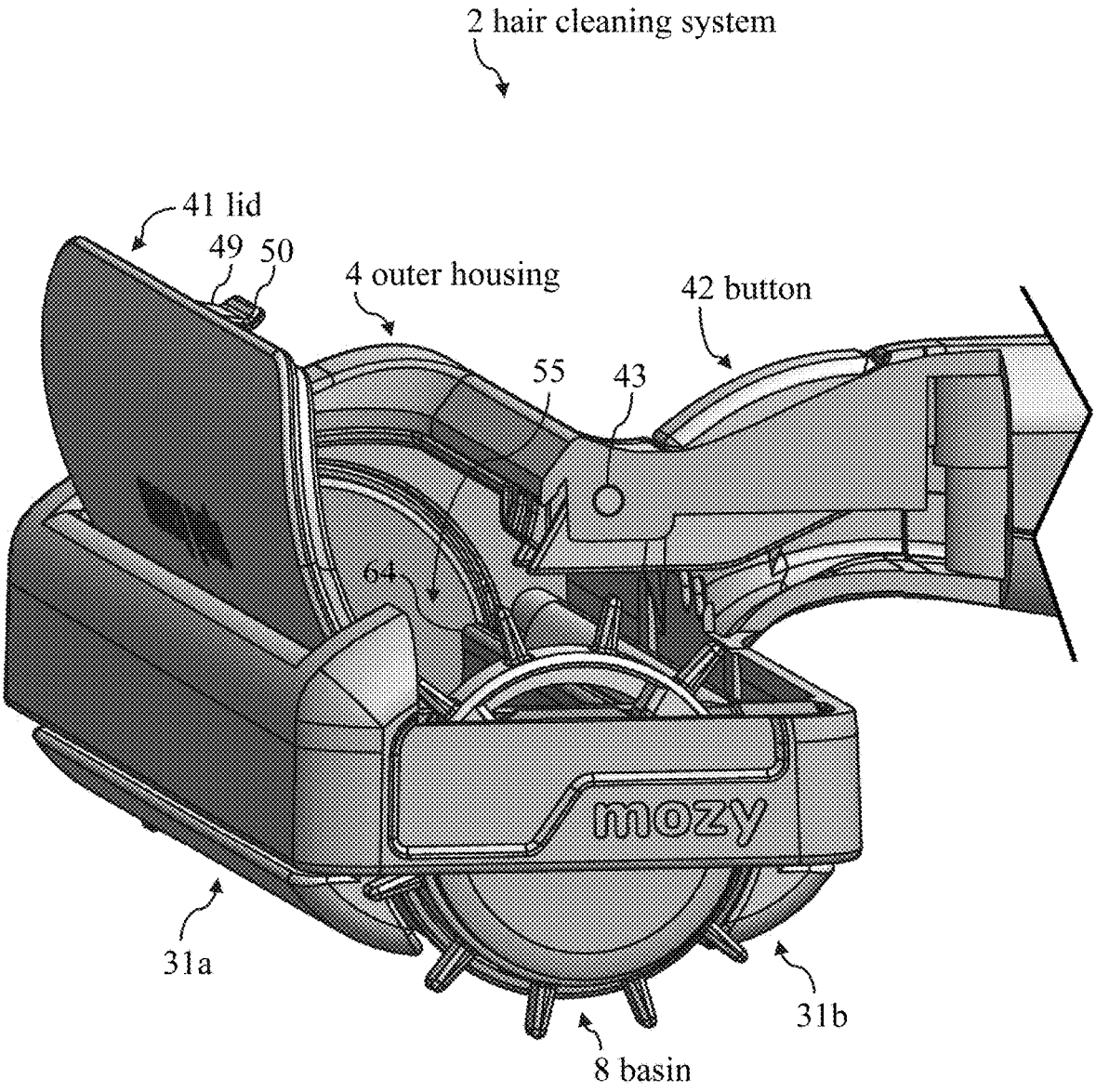
FIG. 11 illustrates a perspective view of a portion of the hair cleaning system in which a lid is open and a portion of an outer housing has been hidden, according to some embodiments.

A pivot joint 43 (labeled in FIG. 11) can pivotably couple the button 42 to the outer housing 4. The pivot joint 43 can comprise a shaft 49, which can be cylindrical. The pivot joint 43 can comprise a channel 48 configured to secure the shaft 49 to the outer housing 4. The shaft 49 can be located at least partially in the channel 48. Other pivot joints can be constructed similarly, according to some embodiments.

The lid 42 can comprise a cantilever beam 49 configured to flex to enable to a protrusion 50 to move past a wall that forms an undercut 44 and then be secured to the undercut 44 of the outer housing 50.

The button 42 can comprise at least one cantilever beam 46. The shaft 49 can be coupled to a leftward (or rightward) side of the cantilever beam 46. Pushing the button 42 downward (as indicated by arrow 52) can cause the cantilever beam 46 to rotate about the pivot joint 43, which causes a frontside 45 of the button 42 to push the protrusion out from under the undercut 44, and thereby unlatches the lid 41 and pushes the lid 41 upward to expose the opening 55 to the interior 57 of the basin 8 to enable removing collected hair from the interior 57.

In some embodiments, a first leftward portion 68 of the outer housing 4 comprises a third wall 88 that protrudes inward and is coupled to the first wall 81 such that the first wall 81 and the third wall 88 form a T shape and such that the third wall 88 is configured to brace the first wall 81 against a force 119 of the first wall 81 stopping a rotation 117 of the second wall 83.

In some embodiments, a first leftward portion 68 of the outer housing 4 comprises a wall 89 that protrudes inward and is coupled to another wall 82 such that the walls 82, 89 form a T shape and such that a wall 89 is configured to brace the wall 82 against a force 120 of the wall 82 stopping a rotation 118 of a wall 84 of the basin 8. A cushioning member (which can be rubber or any other material) can be located between the walls 82, 84 to reduce sound that would otherwise be caused by collisions between the walls 82, 84 and to reduce a severity of the impact between the walls 82, 84 to reduce a risk of a portion of the hair cleaning system 2 breaking due to repetitive impacts between the walls 82, 84.

In some embodiments, a front tray 31*a* comprises the first concave surface 18. A third pivot joint 28 can pivotably couple the front tray 31*a* to the outer housing 4. The first convex outer surface 15 can comprise first bristles 121*a* configured to pick up the second hair. The first concave surface 18 can comprise second bristles 121*c* configured to remove the second hair from the first convex outer surface 15 such that the second hair enters an interior 57 of the basin 8.

Figure 15:
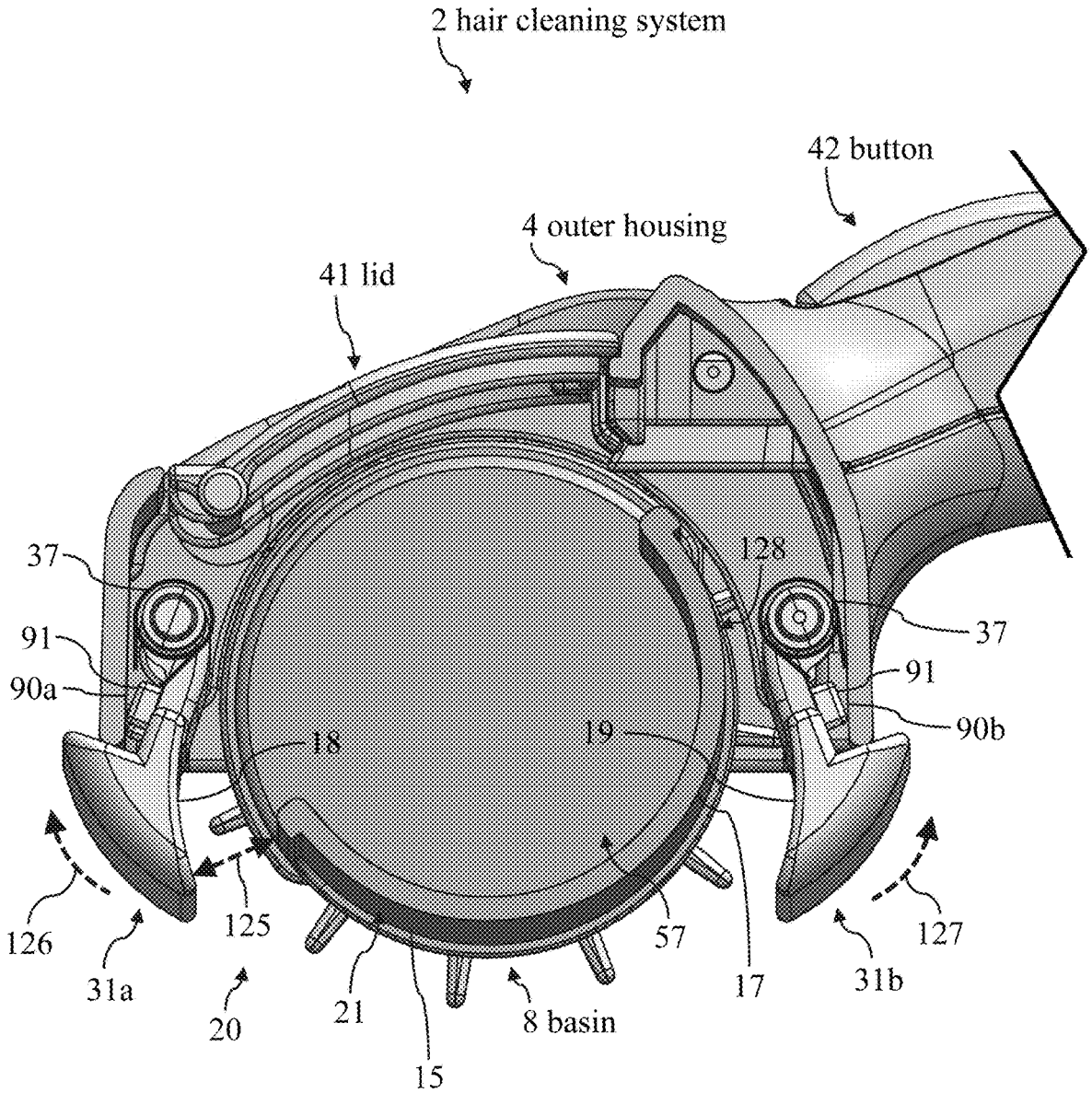

In some embodiments, a first side 123 (labeled in FIG. 4) of the front tray 31*a* comprises second bristles 121*c* and a second side 124 (labeled in FIG. 4) of the front tray 31*a* located opposite to the first side of the front tray 31*a* comprises a first protrusion 91 that protrudes away from the second bristles 121*c* toward an interior wall 90*a* of the outer housing 4 such that the first protrusion 91 is configured to collide with the interior wall 90*a* of the outer housing 4 to limit a rotation 126 of the front tray 31*a* about a pivot joint 28 relative to the outer housing 4 to limit a gap width 125 (labeled in FIG. 15) between the front tray 31*a* and the basin 8 to prevent the second hair from falling out of the interior 57 of the basin 8 through the gap width.

A back tray 31*b* comprises a protrusion 91 that protrudes toward an interior wall 90*b* of the outer housing 4 such that the protrusion 91 is configured to collide with the interior wall 90*b* of the outer housing 4 to limit a rotation 127 of the back tray 31*b* about a pivot joint 30 relative to the outer housing 4 to limit a gap width 125.

In some embodiments, a first torsion spring 37 (labeled in FIG. 15) applies a rotational force that presses the front tray 31*a* toward the basin 8 and toward the first convex outer surface 15, and thereby presses the first concave surface 18 having bristles 121*c* toward bristles 121*a* of the first convex outer surface 15. A torsion spring 37 can have a first arm that presses against an interior wall 90*a* of the outer housing 4 and can have a second arm that presses against a second side 124 (labeled in FIG. 4) of the front tray 31*a*, which enables the torsion spring 37 to apply a torque that pushes the front tray 31*a* toward the basin 8 to enable bristles 121*c* to remove hair 12 from bristles 121*a*.

In some embodiments, a second torsion spring 37 applies a rotational force that presses the back tray 31*b* toward the basin 8 and toward the second convex outer surface 17, and thereby presses the second concave surface 19 having bristles 121*d* toward bristles 121*b* of the second convex outer surface 17. A cylindrical portion of a torsion spring 37 can be placed on a rod 182 of the trays 31*a*, 31*b*.

In some embodiments, the outer housing 4 comprises a handle 62 configured to enable a person to hold onto while using the hair cleaning system 2. The handle 62 can have a shape that is easy for a hand of the person to wrap around.

In some embodiments, a basin 8 comprises an opening 55 having a frontside 63 and a backside 64. The backside 64 can be located opposite relative to the frontside 63. The backside 64 can be located closer than the frontside 63 to the handle 62. The outer housing 4 can comprise a lid 41 configured to be movable to expose the opening 55 to an interior 57 of the basin 8 to enable removing the first hair and the second hair from the interior 57. A pivot joint can pivotably couple the lid 41 to the rest of the outer housing 4 such that the lid 41 can pivot open.

In some embodiments, a first convex outer surface 15 of the basin 8 comprises first bristles 121*a* that are predominantly slanted toward the frontside 63 of the opening 55 of the basin 8. The basin 8 can comprise a second convex outer surface 17 having second bristles 121*b* that are predominantly slanted toward the backside 64 of the opening 55 of the basin 8. The first concave surface 18 can comprise third bristles 121*c* that are predominantly slanted toward the lid 41.

In some embodiments, a back tray 31*b* comprises a second concave surface 19. A hair cleaning system 2 can comprise a second concave surface 19 having fourth bristles 121*d* that are predominantly slanted toward the lid 41. The second concave surface 19 can be pivotably coupled to the outer housing 4 and configured to contact at least a second portion 128 of the second convex outer surface 17 as the second convex outer surface 17 rotates relative to the second concave surface 19 such that the fourth bristles 121*d* are configured to remove a third hair from the second bristles 121*b* of the second convex outer surface 17 such that the third hair enters the basin 8.

In some embodiments, a hair cleaning system 2 comprises a first pivot joint 24 that pivotably couples a first leftward side 129 of the outer housing 4 to a second leftward side 130 of the basin 8. The first pivot joint 24 can comprise a first axis 10 of rotation.

In some embodiments, a pivot joint comprises a shaft and a hole in which the shaft turns. The structure of the hair cleaning system 2 can hold at least a portion of the shaft inside the hole to enable rotation between two parts of the hair cleaning system 2.

In some embodiments, a pivot joint 24 comprises a shaft 26 (or a rod) and a channel 27 in which the shaft turns. The channel can be configured to hold a portion of the shaft (or rod) inside the channel to enable rotation between two parts of the hair cleaning system 2. A hinge 25 is one type of pivot joint.

Figure 9:
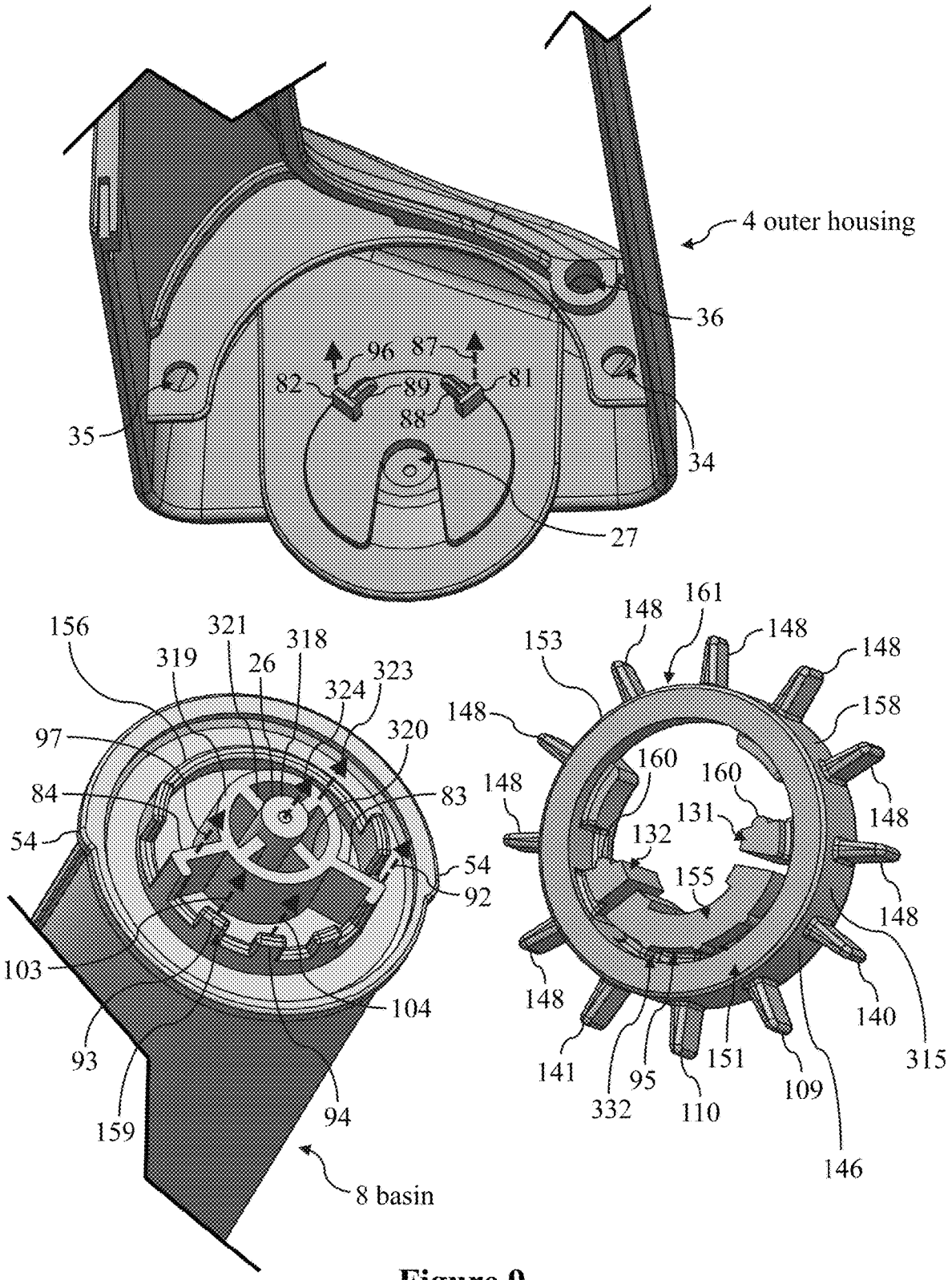
FIG. 9 illustrates a perspective view of portions of various components of the hair cleaning system prior to the components being assembled, according to some embodiments.
Figure 10:
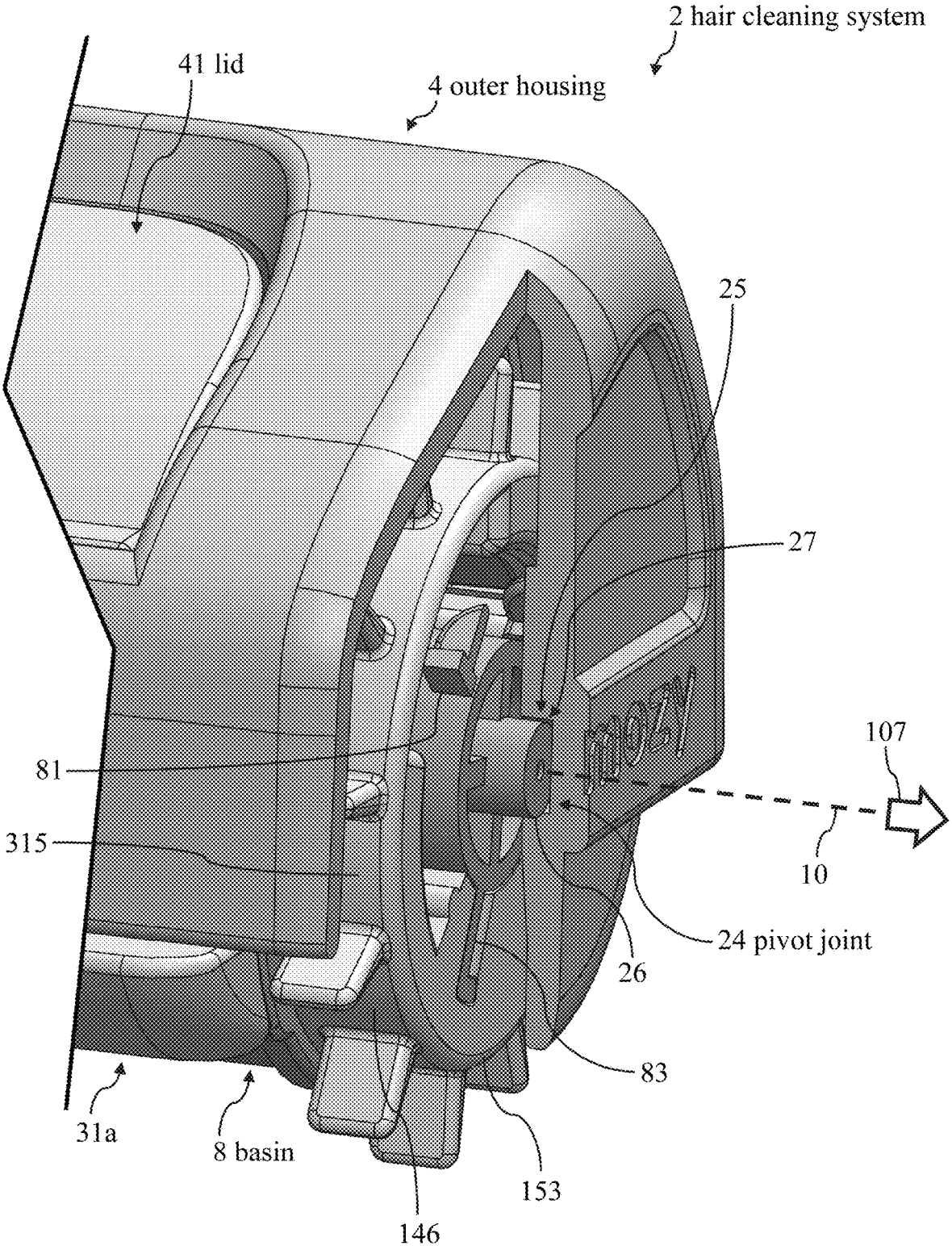
FIG. 10 illustrates a perspective view of a portion of the hair cleaning system in which a leftward portion of an outer housing has been hidden, according to some embodiments.

As illustrated in FIGS. 4, 6, and 9, a pivot joint 28 can pivotably couple a first front tray 31*a* to the outer housing 4, a pivot joint 30 can pivotably couple a second back tray 31*b* to the outer housing 4, and a pivot joint 29 can pivotably couple the lid 41 to the outer housing 4. A pivot joint 28 can comprise a hole 34 and a shaft 38. A pivot joint 30 can comprise a hole 35 and a shaft 39. A pivot joint 29 can comprise a hole 36 and a shaft 40. In some embodiments, pivot joints 28, 29, 30 can be hinges, but many types of pivot joints can be used with the embodiments described herein.

In some embodiments, a first leftward side 129 of the outer housing 4 comprises a first wall 81 that protrudes inward in a first direction 87 and a second wall 82 that protrudes inward in a second direction 96. The first direction 87 and the second direction 96 can be within 10 degrees and/or within 20 degrees of parallel to the first axis 10 of rotation.

In some embodiments, a second leftward side 130 of the basin 8 comprises a third wall 83 and a fourth wall 84 that protrude outward toward the first leftward side 129 of the outer housing 4. The first wall 81 can be configured block a first rotation 117 of the third wall 83 about the first axis 10. The second wall 82 can be configured to block a second rotation 118 of the fourth wall 84 about the first axis 10 such that the first wall 81 and the second wall 82 limit a maximum rotation 85 of the basin 8 relative to the outer housing 4 to less than 140 degrees.

In some embodiments, the third wall 83 protrudes outward toward the first leftward side 129 of the outer housing 4 in a third direction 92 that is within 20 degrees of parallel to the first axis 10 of rotation. The fourth wall 84 can protrude outward toward the first leftward side 129 of the outer housing 4 in a fourth direction 97 that is within 20 degrees of parallel to the first axis 10 of rotation.

In some embodiments, a first rubber piece 131 is located adjacent to at least one of the first wall 81 and the third wall 83 such that the first rubber piece 131 is configured to provide a first cushion 135 when the first wall 81 blocks the first rotation of the third wall 83. In some embodiments, the first rubber piece 131 is located within 1 millimeter of at least one of the first wall 81 and the third wall 83.

In some embodiments, a second rubber piece 132 is located adjacent to at least one of the second wall 82 and the fourth wall 84 such that the second rubber piece 132 is configured to provide a second cushion 135 when the second wall 82 blocks the second rotation of the fourth wall 84. In some embodiments, the second rubber piece 132 is located within 1 millimeter of at least one of the second wall 82 and the fourth wall 84. The first rubber piece 131 and the second rubber piece 132 can be located on opposite sides 133, 134 of the first pivot joint 24.

In some embodiments, a hair cleaning system 2 comprises a first pivot joint 24 that pivotably couples a first leftward portion 68 of the outer housing 4 to a second leftward portion 70 of the basin 8. The first pivot joint 24 comprises a first axis 10 of rotation. A first wall 81 can be coupled to the outer housing 4. The first wall 81 can be configured to limit a maximum rotation 85 of the basin 8 relative to the outer housing 4 by blocking travel 115 of a second wall 83 of the basin 8.

Figure 21:
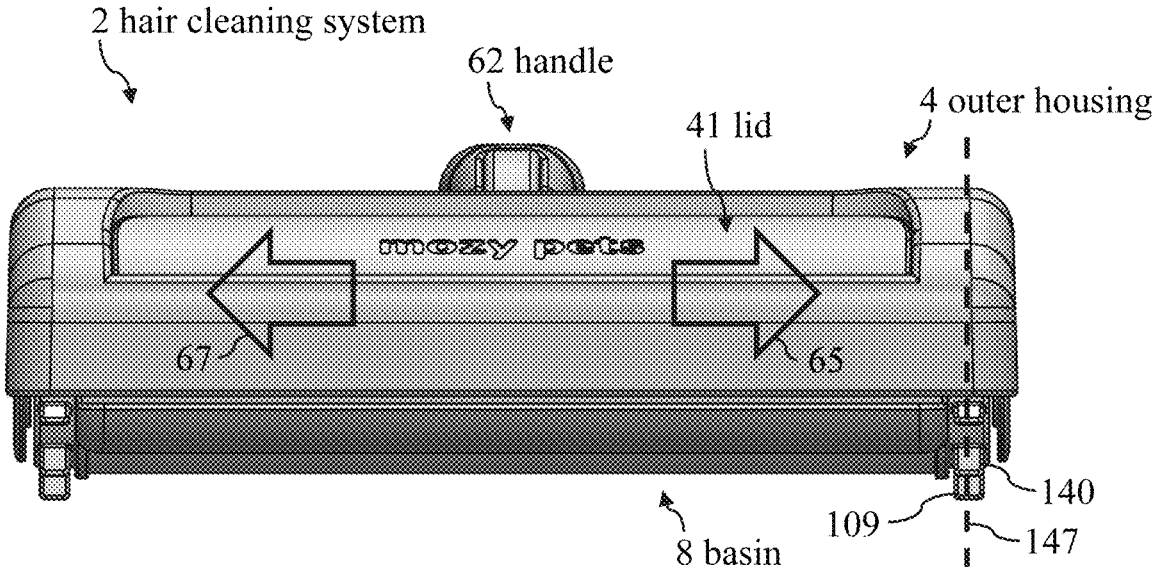
FIG. 21 illustrates a front view of the hair cleaning system, according to some embodiments.

In some embodiments, a first protrusion 140, a second protrusion 109, a third protrusion 110, and a fourth protrusion 141 are spaced apart along an outer perimeter 145 of the basin 8 such that a cross section 147 (labeled in FIG. 21) that is oriented perpendicular to the first axis 10 comprises portions of the first protrusion 140, the second protrusion 109, the third protrusion 110, and the fourth protrusion 141. The first protrusion 140, the second protrusion 109, the third protrusion 110, and the fourth protrusion 141 can protrude radially outward relative to the first axis 10 such that the first protrusion 140, the second protrusion 109, the third protrusion 110, and the fourth protrusion 141 are configured to provide traction 170 to help rotate the basin 8 relative to the outer housing 4. Embodiments can have many protrusions 109, 110, 140, 141, 148 around an outer perimeter 145.

In some embodiments, the outer housing 4 comprises a first downward-facing opening 98 and a second downward-facing opening 99. The first downward-facing opening 98 and the second downward-facing opening 99 can be located on opposite sides 133, 134 of the first pivot joint 24. As illustrated in FIG. 7, a first protrusion 140 can be configured to enter the first downward-facing opening 98 when the basin 8 rotates in a first direction 101 relative to the outer housing 4. As illustrated in FIG. 8, a fourth protrusion 141 can be configured to enter the second downward-facing opening 99 when the basin 8 rotates in a second direction 102 relative to the outer housing 4 (such that this particular second direction 102 is rotationally opposite relative to the first direction 101).

In some embodiments, a second leftward portion 70 of the basin 8 comprises a third wall 93 that protrudes in a first direction 103 and a fourth wall 94 that protrudes in a second direction 104. The first direction 103 and the second direction 104 can be toward the first leftward portion 68 of the outer housing 4 and within 20 degrees of parallel to the first axis 10. The third wall 93 and the fourth wall 94 secure a base 151 of a protrusion 109 such that the base rotates with the basin 8.

Some embodiments comprise a hoop 153 having protrusions 109, 110, 140, 141, 148 around an outer perimeter 146. A leftward portion of the basin 8 can comprise a cylinder 156 that is aligned with a first axis 10 of rotation. The hoop 153 can be located around the cylinder 156 such that the cylinder 156 supports the hoop 153 in a radially outward direction (relative to the first axis 10).

In some embodiments, a hoop 153 can comprise a cylindrical outer shape 158 with protrusions 109, 110, 140, 141, 148 that protrude radially outward to provide traction 170 to help rotate the basin 8 relative to the outer housing 4 as a person moves the handle 62 back and forward (e.g., as indicated by arrows 13, 14) over a surface 61 on which there is hair 12 that the person wants to pick up with the hair cleaning system 2. In some embodiments, the hoop 153 can be a ring shape. Embodiments use many different types of hoop shapes.

In some embodiments, a second leftward portion 70 of the basin 8 comprises a third wall 93 that protrudes in a first direction 103 and a fourth wall 94 that protrudes in a second direction 104. The first direction 103 and the second direction 104 can be toward the first leftward portion 68 of the outer housing 4 and within 20 degrees of parallel to the first axis 10. The third wall 93 and the fourth wall 94 can secure the hoop 153 such that the hoop 153 rotates with the basin 8.

The basin 8 can comprise features (e.g., 84, 83, 94, 93) that interlock with features (e.g., 95, 131, 132, 155) of the hoop 153 to ensure the hoop 153 rotates with the basin 8 while protrusions (e.g., protrusions 109, 110, 140, 141, 148) flex due to contact with the surface 61 on which there is hair 12 that the person wants to pick up.

In some embodiments, the hoop 153 comprises rubber material and a cavity 95. At least a portion 159 of the third wall 93 can be located inside the cavity 95 to rotationally couple the hoop 153 to the basin 8. The hoop 153 can comprise a rubber bumper 160 configured to act as a cushion between the first wall 81 and the second wall 83. In some embodiments, the rubber bumper 160 comprises a semi-cylindrical cross section.

Some embodiments comprise a hoop 153 having protrusions 109, 110, 140, 141, 148. Walls 83, 84, 93, 94 can rotationally secure the hoop 153 such that the hoop 153 rotates with the basin 8. The hoop 153 can be secured along a first axis 10 of rotation by the basin 8 on one side and by the outer housing 4 on the other side.

In some embodiments, the hoop 153 comprises rubber material and a wedge shape 155 (labeled in FIG. 9) located between a second wall 83 and a third wall 84 of the basin 8 such that the wedge shape 155 is configured to rotationally secure the hoop 153 such that the hoop 153 rotates with the basin 8 while protrusions (e.g., protrusions 109, 110, 140, 141, 148) flex due to contact with the surface on which there is hair that the person wants to pick up. Protrusions 109, 110, 140, 141, 148 can be flexible cantilever beams 305 molded from silicone. Protrusions 109, 110, 140, 141, 148 can be tapered such that a distal end is thinner (e.g., has less cross sectional area as measured perpendicular to a central axis from a proximal end to a distal end) than a proximal end. This tapering can provide excellent traction 170 while also being gentle on the surface 61.

Figure 13:
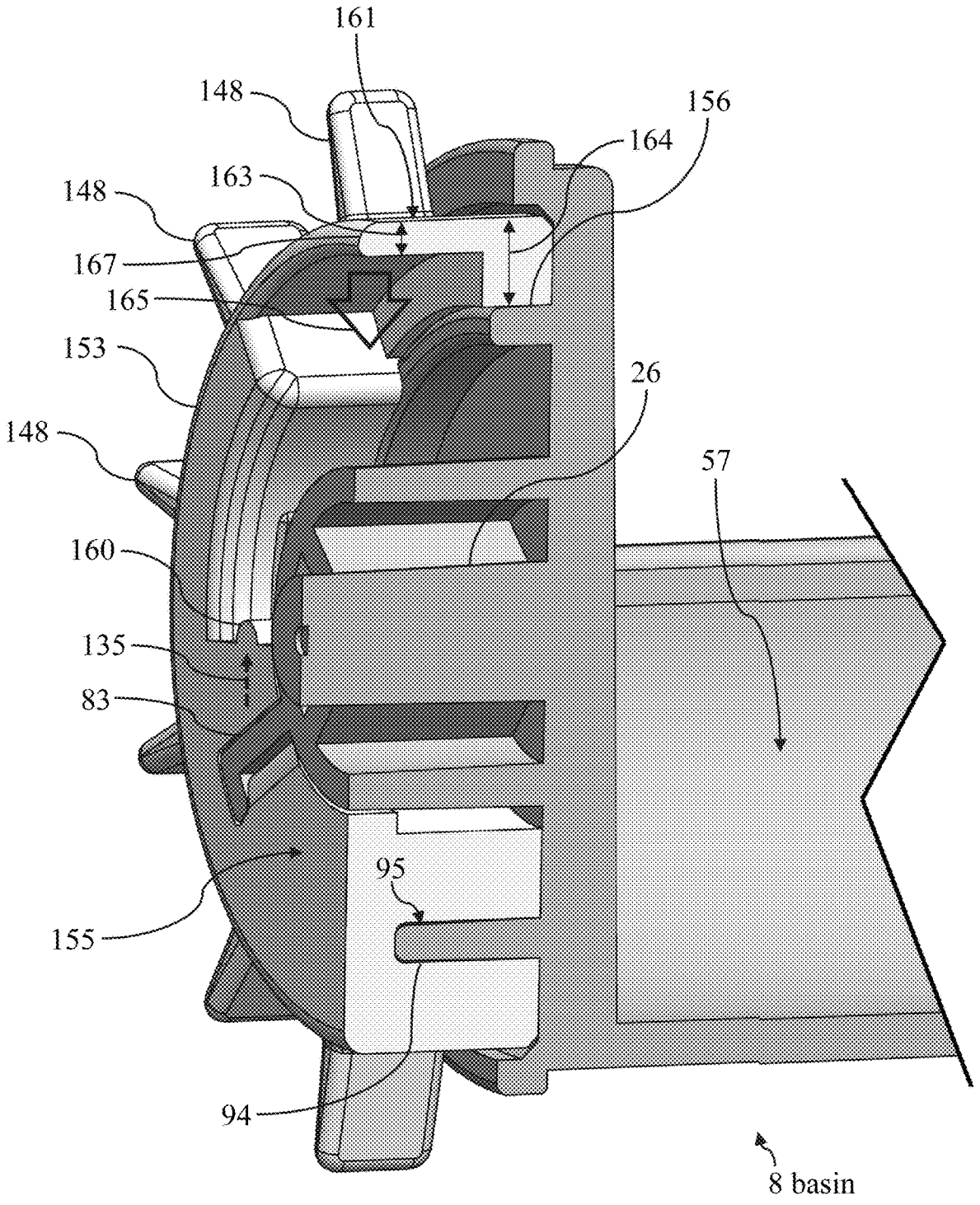
FIG. 13 illustrates a perspective view of a portion of a basin and a portion of a hoop, according to some embodiments.
Figure 14:
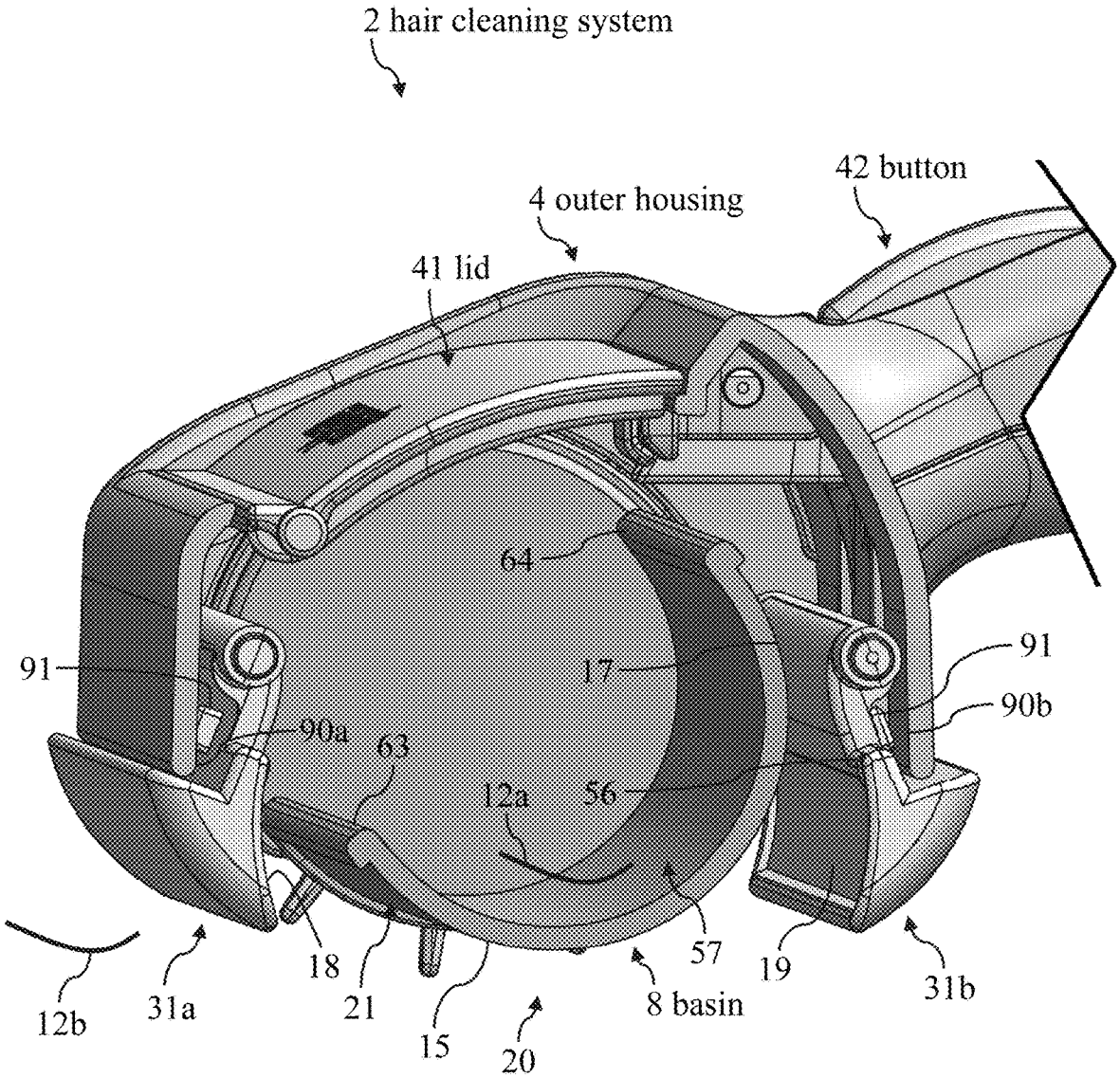
FIGS. 14 and 15 illustrate perspective views of a portion of the hair cleaning system in which a leftward portion of the hair cleaning system has been hidden, according to some embodiments.

In some embodiments, the hoop 153 comprises a roof 161 (labeled in FIG. 13) located on an opposite side of the first pivot joint 24 relative to the wedge shape 155. The roof 161 can comprise a first radial thickness 164 and a second radial thickness 163 that is at least 40 percent less than the first radial thickness 164 such that the roof 161 is configured to flex (e.g., as indicated by arrow 165) in an area 167 of the second radial thickness 163 as the hoop 153 is pushed past the first wall 81 and a fourth wall 82 during assembly of the hoop 153 into the outer housing 4. The second radial thickness 163 can be located leftward relative to the first radial thickness 164.

This flex indicated by arrow 165 enables the basin 8 to be assembled upward into the outer housing 4, which would otherwise not be possible due to walls 81, 82 colliding with the hoop 153 and thereby preventing the insertion of the basin 8 and hoop 153 assembly into the outer housing 4. However, the flexibility of the second radial thickness 163 enables the area 167 to move out of the way of the walls 81, 82 while the radially rigidity of the first radial thickness 164 combined with the cylinder 156 enables the hoop 153 to remain attached to the basin 8 and enables the area 167 to bounce back into position once the area 167 is past the walls 81, 82.

In some embodiments, at least one outward facing portion 168 of the basin 8 comprises bristles 121*a*, 121*b* configured to pick up the second hair. The first axis 10 can define a leftward direction 107. Leftward of the bristles 121*a*, 121*b*, a first rubber protrusion 109, a second rubber protrusion 110, and a third rubber protrusion 140 can be coupled to the basin 8, protrude radially outward relative to the first axis 10 at least 3 millimeters, at least 5 millimeters, and less than 15 millimeters, and can be spaced apart from each other at least 3 millimeters, at least 5 millimeters, and less than 18 millimeters along a convex outer perimeter 169 such that the first rubber protrusion 109, the second rubber protrusion 110, and the third rubber protrusion 140 are configured to provide traction 170 to help rotate the basin 8 relative to the outer housing 4.

In some embodiments, outer facing portions 168 of the basin 8 comprise a central portion 171 having bristles 121*a*, 121*b* configured to pick up the second hair and a leftward end portion 172 located leftward of the bristles 121*a*, 121*b* such that the leftward end portion 172 does not comprise any bristles. The leftward end portion 172 comprises a first rubber protrusion 109, a second rubber protrusion 110, and a third rubber protrusion 140 that protrude radially outward relative to the first axis 10 and that are spaced apart from each other along a convex outer perimeter 169 of the leftward end portion 172 such that the first rubber protrusion 109, the second rubber protrusion 110, and the third rubber protrusion 140 are configured to provide traction 170 to help rotate the basin 8 relative to the outer housing 4.

In some embodiments, the first convex outer surface 15 of the basin 8 comprises first bristles 121*a* configured to pick up the second hair. A basin 8 can comprise a second convex outer surface 17 comprising second bristles 121*b* configured to pick up a third hair. The second bristles 121*b* can be located closer to a handle 62 of the outer housing 4 than the first bristles 121*a*.

In some embodiments, a hair cleaning system 2 comprises a first protrusion 109 that is coupled to the basin 8, protrudes at least 3 millimeters radially outward relative to the first axis 10 of rotation in a first direction 111, and is located leftward of the first bristles 121*a*. The hair cleaning system 2 can comprise a second protrusion 110 that is coupled to the basin 8, protrudes at least 3 millimeters radially outward relative to the first axis 10 of rotation in a second direction 112, and is located leftward of the second bristles 121*b*. An angle 113 between the first direction 111 and the second direction 112 can be greater than 15 degrees and less than 80 degrees.

In some embodiments, a hair cleaning system 2 comprises an outer housing 4 and a basin 8 pivotably coupled to the outer housing 4. The basin 8 can be configured to hold a first hair inside the outer housing 4. The basin 8 can comprise a first convex outer surface 15 configured to pick up a second hair from a floor 301 (e.g., of a building). A hair cleaning system 2 can comprise a second surface 18 pivotably coupled to the outer housing 4 and configured to remove the second hair from the first convex outer surface 15 such that the second hair enters the basin 8.

In some embodiments, a hair cleaning system 2 comprises a first hoop 153 coupled to the basin 8 and having a first protrusion 140, a second protrusion 109, a third protrusion 110, and additional protrusions spaced apart along a first outer perimeter 146 of the first hoop 153. The protrusions can be spaced equidistant apart along an entirety of an outer circumference 302 of the first hoop 153 and/or along a portion of the outer circumference 302 of the first hoop 153. The protrusions can be cantilever beams 305 or any other suitable shape. The first protrusion 140, second protrusion 109, third protrusion 110, and additional protrusions of the first hoop 153 can be configured to contact the floor 301 to provide traction 170 to cause a first rotation 307 of the basin 8 relative to the outer housing 4 as the outer housing 4 is moved along the floor 301.

In some embodiments, the outer housing 4 comprises a first wall 81 and at least one of the first hoop 153 and the basin 8 comprises a second wall 83. (The second wall can be a second wall 308 of the first hoop 153.) The first wall 81 can be configured to limit a first maximum rotation 85 of the first hoop 153 relative to the outer housing 4 by blocking a first travel 115 of the second wall 83 such that the first hoop 153 is configured to provide the traction 170 to cause the first rotation as the outer housing 4 is moved along the floor 301 in a first forward direction 309 but the first hoop 153 does not cause additional rotation beyond the first rotation of the basin 8 relative to the outer housing 4 as the outer housing 4 is moved further along the floor 301 in the first forward direction 309. In some embodiments, the first maximum rotation 85 is less than 140 degrees.

In some embodiments, a hair cleaning system 2 comprises a first axis 10 of rotation between the outer housing 4 and the basin 8. The second wall 83 can protrude leftward 311 from a leftward side 130 of the basin 8 in a second direction 92 within 20 degrees of parallel to the first axis 10. The first wall 81 of the outer housing 4 can protrude rightward 312 from a leftward side 129 of the outer housing 4 in a third direction 87 within 20 degrees of parallel to the first axis 10.

In some embodiments, the first hoop 153 comprises a first cavity 95 having a first opening 332 oriented rightward. The basin 8 can comprise a third wall 93 that protrudes leftward from the leftward side 130 of the basin 8 in a fourth direction 103 within 20 degrees of parallel to the first axis 10. The third wall 93 can be located at least partially inside the first cavity 95 such that the third wall 93 rotationally locks the first hoop 153 to the basin 8.

In some embodiments, the first hoop 153 comprises a cylindrical band 315. The first protrusion 140, the second protrusion 109, and the third protrusion 110 can protrude radially outward from the cylindrical band 315.

In some embodiments, the first hoop 153 comprises a plurality of protrusions, the plurality of protrusions comprises the first protrusion 140, the second protrusion 109, and the third protrusion 110, and the plurality of protrusions protrudes radially outward from the cylindrical band 315 and are spaced apart around at least 260 degrees of an outer circumference 302 of the cylindrical band 315.

In some embodiments, the first hoop 153 comprises a fourth protrusion 316 that protrudes radially inward in an area adjacent to the second wall 83 such that the fourth protrusion 316 is configured to be a cushion 317 between the first wall 81 and the second wall 83 as the first wall 81 limits the first maximum rotation 85 of the first hoop 153 relative to the outer housing 4 by blocking the first travel 115 of the second wall 83. The fourth protrusion 316 can be wedge-shaped and can be made of at least one of a rubber, a silicone, an elastomer, and a thermoplastic polyurethane.

In some embodiments, a hair cleaning system 2 comprises a first axis 10 of rotation between the outer housing 4 and the basin 8. The basin 8 can comprise a first cylinder 318 that protrudes from a leftward side 130 of the basin 8 in a second direction 324 that is within 20 degrees of parallel to the first axis 10. The basin 8 can comprise a second cylinder 319 that protrudes from the leftward side 130 of the basin 8 in a third direction 323 that is within 20 degrees of parallel to the first axis 10. The first cylinder 318 can be located at least partially inside the second cylinder 319. The basin 8 can comprise a first rib 320 and a second rib 321 that protrude radially inward to couple the first cylinder 318 to the second cylinder 319. The first hoop 153 can be concentric with the first cylinder 318 and the second cylinder 319. The hair cleaning system 2 can comprise a pivot 24 between the outer housing 4 and the basin 8. The pivot can comprise the first cylinder 318. In some embodiments, the second wall 83 is coupled to the second cylinder 319 and protrudes radially outward from the second cylinder 319.

In some embodiments, the first hoop 153 is coupled to a leftward end 325 of the basin 8. The hair cleaning system 2 further can comprise a second hoop 153 is coupled to a rightward end 326 of the basin 8, wherein the second hoop 153 comprises cantilever beams 305 that are at least 3 millimeters long and spaced equidistant around an entire second outer perimeter 146 of the second hoop 153.

In some embodiments, a hair cleaning system 2 comprises a first axis 10 of rotation between the outer housing 4 and the basin 8. The first hoop 153 can comprise a cylindrical band 315 having a first radius 329 as measured from the first axis 10. The first protrusion 140, the second protrusion 109, and the third protrusion 110 can protrude radially outward from the cylindrical band 315. The first convex outer surface 15 of the basin 8 comprises a second radius 328 measured from the first axis 10. The first protrusion 140 can comprise a maximum thickness 330 measured along the first outer perimeter 146 of the first hoop 153.

In some embodiments, the first radius plus the maximum thickness is less than the second radius such that the first protrusion 140 is configured to bend to lay against the cylindrical band 315 and be below a level 331 of the first convex outer surface 15 to prevent the first protrusion 140 from prohibiting the first convex outer surface 15 from contacting the floor 301.

In some embodiments, the outer housing 4 comprises a third wall 82 and the first hoop 153 comprises a fourth wall 330. The third wall 82 can be configured to limit a second maximum rotation 85*b* of the first hoop 153 relative to the outer housing 4 by blocking a second travel 335 of the fourth wall 330 as the outer housing 4 is moved along the floor 301 in a first backward direction 310. The second maximum rotation 85*b* can be rotationally opposite the first maximum rotation 85.

In some embodiments, a hair cleaning system 2 comprises a first axis 10 of rotation between the outer housing 4 and the basin 8. The third wall 82 of the outer housing 4 can protrude rightward from a leftward side 129 of the outer housing 4 in a second direction within 20 degrees of parallel to the first axis 10.

In some embodiments, a hair cleaning system 2 comprises an outer housing 4; a basin 8 pivotably coupled to the outer housing 4, wherein the basin 8 is configured to hold a first hair inside the outer housing 4, and the basin 8 comprises a first convex outer surface 15 configured to pick up a second hair from a floor 301; and a second surface 18 pivotably coupled to the outer housing 4 and configured to remove the second hair from the first convex outer surface 15 such that the second hair enters the basin 8.

In some embodiments, a hair cleaning system 2 comprises a first axis 10 of rotation between the outer housing 4 and the basin 8. The hair cleaning system 2 can comprise a first hoop 153 coupled to a leftward end of the basin 8 and having a first protrusion 140, a second protrusion 109, a third protrusion 110, and additional protrusions spaced apart along a first outer perimeter 146 of the first hoop 153. The outer housing 4 can comprise a first wall 81. At least one of the first hoop 153 and the basin 8 can comprise a second wall 83. The first wall 81 can be configured to limit a first maximum rotation 85 of the first hoop 153 relative to the outer housing 4 by blocking a first travel of the second wall 83. The first, second, and third protrusions of the first hoop 153 can be configured to contact the floor to provide traction 170 to cause a first rotation 307 of the basin 8 relative to the outer housing 4 as the outer housing 4 is moved along the floor until the first wall 81 limits the first maximum rotation 85 by blocking the first travel of the second wall 83. In some embodiments, the first maximum rotation 85 is less than 140 degrees.

In some embodiments, the first hoop 153 comprises a first cavity having a first opening 332 oriented rightward, the basin 8 comprises a third wall 93 that protrudes leftward from a leftward side of the basin 8 in a first direction within 20 degrees of parallel to the first axis 10, the third wall 93 is located at least partially inside the first cavity such that the third wall 93 rotationally locks the first hoop 153 to the basin 8.

In some embodiments, a hair cleaning system 2 comprises a pivot joint 24 that pivotably couples the basin 8 to the outer housing 4. The pivot joint can comprise a first cylinder 318 that protrudes leftward from the basin 8. The basin 8 can comprise a second cylinder 319 that protrudes leftward from a leftward side of the basin 8. The basin 8 can comprise a first rib 320 and a second rib 321 that couple the first cylinder 318 to the second cylinder 319. The second wall 83 can protrude radially outward from the second cylinder 319. The basin 8 can comprise a fourth wall 84 that protrudes radially outward from the second cylinder 319. The outer housing 4 can comprise a fifth wall 82 configured to limit a second maximum rotation 85*b* of the first hoop 153 relative to the outer housing 4 by blocking a second travel 335 of the of the fourth wall 84. The second maximum rotation 85*b* can be rotationally opposite the first maximum rotation 85. A portion of the hoop can be rotationally coupled between the second wall 83 and the fourth wall 84 to enable the traction to cause the first rotation.

In some embodiments, a hair cleaning system 2 comprises a pivot joint 24 that pivotably couples the basin 8 to the outer housing 4. The first hoop 153 can comprise a roof 161 located on an opposite side of the pivot joint relative to the first cavity 95. The roof 161 can comprise a first radial thickness 164 and a second radial thickness 163 163 that is at least 40 percent less than the first radial thickness 164 164. The second radial thickness 163 can be located leftward relative to the first radial thickness 164. The first radial thickness 164 can be configured (due to its greater thickness than the second radial thickness 163) to resist collapse of the roof 161 as the first hoop 153 is pushed past the first wall 81 during assembly of the first hoop 153 into the outer housing 4. The second radial thickness 163 can be configured to flex (while being supported from collapse by the first radial thickness 164) as the first hoop 153 is pushed past the first wall 81 during assembly of the first hoop 153 into the outer housing 4 to enable the first hoop 153 to move past the first wall 81.

In embodiments described herein, rightward portions can have any of the features described in the context of leftward portions such that rightward portions can be mirror images of leftward portions.

Interpretation

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1, and embodiments described in other sections may apply to and be combined with embodiments described within the "Topic 1" section.

Some of the devices, systems, embodiments, and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer-readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

The invention is claimed:

1. A hair cleaning system comprising:

an outer housing;

a basin pivotably coupled to the outer housing, wherein the basin is configured to hold a first hair inside the outer housing, and the basin comprises a first convex outer surface configured to pick up a second hair from a floor;

a second surface pivotably coupled to the outer housing and configured to remove the second hair from the first convex outer surface such that the second hair enters the basin:

a first hoop coupled to the basin and having a first protrusion and a second protrusion spaced apart along a first outer perimeter of the first hoop, wherein the first and second protrusions of the first hoop are configured to contact the floor to provide traction to cause a first rotation of the basin relative to the outer housing as the outer housing is moved along the floor, wherein the outer housing comprises a first wall and at least one of the first hoop and the basin comprises a second wall, wherein the first wall is configured to limit a first maximum rotation of the first hoop relative to the outer housing by blocking a first travel of the second wall such that the first hoop is configured to provide the traction to cause the first rotation as the outer housing is moved along the floor in a first forward direction but the first hoop does not cause additional rotation beyond the first rotation of the basin relative to the outer housing as the outer housing is moved further along the floor in the first forward direction, wherein the first maximum rotation is less than 140 degrees; and a first axis of rotation between the outer housing and the basin, wherein the second wall protrudes leftward from a leftward side of the basin in a second direction within 20 degrees of parallel to the first axis, and the first wall of the outer housing protrudes rightward from a leftward side of the outer housing in a third direction within 20 degrees of parallel to the first axis.

2. The hair cleaning system of claim 1, wherein the first hoop comprises a first cavity having a first opening oriented rightward, the basin comprises a third wall that protrudes leftward from the leftward side of the basin in a fourth direction within 20 degrees of parallel to the first axis, and the third wall is located at least partially inside the first cavity such that the third wall rotationally locks the first hoop to the basin.

3. The hair cleaning system of claim 1, wherein the first hoop comprises a cylindrical band, and the first protrusion and the second protrusion protrude radially outward from the cylindrical band.

4. The hair cleaning system of claim 3, wherein the first hoop comprises a plurality of protrusions, the plurality of protrusions comprises the first protrusion and the second protrusion, and the plurality of protrusions protrudes radially outward from the cylindrical band and are spaced apart around at least 260 degrees of an outer circumference of the cylindrical band.

5. The hair cleaning system of claim 1, wherein the first hoop comprises a third protrusion that protrudes radially inward in an area adjacent to the second wall such that the third protrusion is configured to be a cushion between the first wall and the second wall as the first wall limits the first maximum rotation of the first hoop relative to the outer housing by blocking the first travel of the second wall.

6. The hair cleaning system of claim 5, wherein the third protrusion is wedge-shaped and is at least one of a rubber, a silicone, an elastomer, and a thermoplastic polyurethane.

7. The hair cleaning system of claim 1, wherein the outer housing comprises a lid and a button configured to unlatch the lid to expose an opening to an interior of the basin to enable removing the first hair and the second hair from the interior.

8. The hair cleaning system of claim 1, wherein the first convex outer surface comprises first bristles configured to pick up the second hair and the second surface comprises second bristles configured to remove the second hair from the first convex outer surface such that the second hair enters an interior of the basin.

9. A hair cleaning system comprising:

an outer housing;

a basin pivotably coupled to the outer housing, wherein the basin is configured to hold a first hair inside the outer housing, and the basin comprises a first convex outer surface configured to pick up a second hair from a floor;

a second surface pivotably coupled to the outer housing and configured to remove the second hair from the first convex outer surface such that the second hair enters the basin:

a first hoop coupled to the basin and having a first protrusion and a second protrusion spaced apart along a first outer perimeter of the first hoop, wherein the first and second protrusions of the first hoop are configured to contact the floor to provide traction to cause a first rotation of the basin relative to the outer housing as the outer housing is moved along the floor, wherein the outer housing comprises a first wall and at least one of the first hoop and the basin comprises a second wall, wherein the first wall is configured to limit a first maximum rotation of the first hoop relative to the outer housing by blocking a first travel of the second wall such that the first hoop is configured to provide the traction to cause the first rotation as the outer housing is moved along the floor in a first forward direction but the first hoop does not cause additional rotation beyond the first rotation of the basin relative to the outer housing as the outer housing is moved further along the floor in the first forward direction, wherein the first maximum rotation is less than 140 degrees; and a first axis of rotation between the outer housing and the basin, wherein the first hoop comprises a cylindrical band having a first radius as measured from the first axis, the first protrusion and the second protrusion protrude radially outward from the cylindrical band, the first convex outer surface of the basin comprises a second radius measured from the first axis, and the first protrusion comprises a maximum thickness measured along the first outer perimeter of the first hoop, wherein the first radius plus the maximum thickness is less than the second radius such that the first protrusion is configured to bend to lay against the cylindrical band and be below a level of the first convex outer surface to prevent the first protrusion from prohibiting the first convex outer surface from contacting the floor.

10. The hair cleaning system of claim 9, further comprising a pivot joint that pivotably couples the basin to the outer housing, wherein the first hoop comprises a roof located on an opposite side of the pivot joint relative to the first cavity.

11. The hair cleaning system of claim 9, wherein the outer housing comprises a lid and a button configured to unlatch the lid to expose an opening to an interior of the basin to enable removing the first hair and the second hair from the interior.

12. The hair cleaning system of claim 9, wherein the first convex outer surface comprises first bristles configured to pick up the second hair and the second surface comprises second bristles configured to remove the second hair from the first convex outer surface such that the second hair enters an interior of the basin.

13. A hair cleaning system comprising:

an outer housing;

a basin pivotably coupled to the outer housing, wherein the basin is configured to hold a first hair inside the outer housing, and the basin comprises a first convex outer surface configured to pick up a second hair from a floor;

a second surface pivotably coupled to the outer housing and configured to remove the second hair from the first convex outer surface such that the second hair enters the basin:

a first hoop coupled to the basin and having a first protrusion and a second protrusion spaced apart along a first outer perimeter of the first hoop, wherein the first and second protrusions of the first hoop are configured to contact the floor to provide traction to cause a first rotation of the basin relative to the outer housing as the outer housing is moved along the floor, wherein the outer housing comprises a first wall and at least one of the first hoop and the basin comprises a second wall, wherein the first wall is configured to limit a first maximum rotation of the first hoop relative to the outer housing by blocking a first travel of the second wall such that the first hoop is configured to provide the traction to cause the first rotation as the outer housing is moved along the floor in a first forward direction but the first hoop does not cause additional rotation beyond the first rotation of the basin relative to the outer housing as the outer housing is moved further along the floor in the first forward direction, wherein the first maximum rotation is less than 140 degrees; and wherein the outer housing comprises a third wall and the first hoop comprises a fourth wall, wherein the third wall is configured to limit a second maximum rotation of the first hoop relative to the outer housing by blocking a second travel of the fourth wall as the outer housing is moved along the floor in a first backward direction, wherein the second maximum rotation is rotationally opposite the first maximum rotation.

14. The hair cleaning system of claim 13, further comprising a pivot between the outer housing and the basin, and the pivot comprises a cylinder.

15. The hair cleaning system of claim 13, further comprising a first axis of rotation between the outer housing and the basin, and the third wall of the outer housing protrudes rightward from a leftward side of the outer housing in a second direction within 20 degrees of parallel to the first axis.

16. The hair cleaning system of claim 13, wherein the first hoop comprises a first cavity, and the third wall is located at least partially inside the first cavity such that the third wall rotationally locks the first hoop to the basin.

17. The hair cleaning system of claim 13, further comprising a pivot joint that pivotably couples the basin to the outer housing, wherein the pivot joint comprises a first cylinder that protrudes leftward from the basin.

18. The hair cleaning system of claim 13, wherein the outer housing comprises a lid and a button configured to unlatch the lid to expose an opening to an interior of the basin to enable removing the first hair and the second hair from the interior.

19. The hair cleaning system of claim 13, wherein the first convex outer surface comprises first bristles configured to pick up the second hair and the second surface comprises second bristles configured to remove the second hair from the first convex outer surface such that the second hair enters an interior of the basin.

* * * * *